US011300894B2

(12) United States Patent
Kurihara

(10) Patent No.: US 11,300,894 B2
(45) Date of Patent: Apr. 12, 2022

(54) IMAGE FORMATION APPARATUS THAT FORMS FIRST TONER IMAGE BY USING BRIGHT TONER CONTAINING BRIGHT PIGMENT AND SECOND TONER IMAGE BY USING NON-BRIGHT TONER

(71) Applicant: Oki Electric Industry Co., Ltd., Tokyo (JP)

(72) Inventor: Kazuteru Kurihara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/377,143

(22) Filed: Jul. 15, 2021

(65) Prior Publication Data

US 2022/0066349 A1 Mar. 3, 2022

(30) Foreign Application Priority Data

Aug. 26, 2020 (JP) ..... JP2020-142723

(51) Int. Cl.
*G03G 15/16* (2006.01)
*G03G 15/01* (2006.01)
*G03G 21/12* (2006.01)

(52) U.S. Cl.
CPC ..... *G03G 15/0163* (2013.01); *G03G 15/1675* (2013.01); *G03G 21/12* (2013.01); *G03G 2215/0174* (2013.01)

(58) Field of Classification Search
CPC ..... G03G 15/161; G03G 15/1645; G03G 15/1675; G03G 21/00; G03G 21/0023
USPC ..... 399/66, 71, 101, 358
See application file for complete search history.

(56) References Cited

U.S. PATENT DOCUMENTS 9,383,690 B1 * 7/2016 Tominaga ..... G03G 15/161
9,846,396 B2 * 12/2017 Nagata ..... G03G 15/1665
2018/0143553 A1 5/2018 Kuwabara

FOREIGN PATENT DOCUMENTS

JP 2018-84677 A 5/2018

* cited by examiner

*Primary Examiner* — William J Royer
(74) *Attorney, Agent, or Firm* — Metrolex IP Law Group, PLLC

(57) ABSTRACT

An image formation apparatus according to an embodiment may include: a first image formation unit that forms a first toner image on a first image carrier by using a bright toner containing a bright pigment; a second image formation unit that forms a second toner image on a second image carrier by using a non-bright toner containing no bright pigment; a transfer unit that transfers the first and second toner images to a transfer body; and a controller that controls the transfer unit. The controller is configured to perform control such that a transfer efficiency of the bright toner in a case where the second toner image is superimposed to the first toner image formed on the transfer body is lower than the transfer efficiency of the bright toner in a case where the second toner image is not superimposed to the first toner image formed on the transfer body.

13 Claims, 9 Drawing Sheets

IMAGE FORMATION APPARATUS THAT FORMS FIRST TONER IMAGE BY USING BRIGHT TONER CONTAINING BRIGHT PIGMENT AND SECOND TONER IMAGE BY USING NON-BRIGHT TONER

CROSS REFERENCE TO RELATED APPLICATIONS

This application claims priority based on 35 USC 119 from prior Japanese Patent Application No. 2020-142723 filed on Aug. 26, 2020, entitled "IMAGE FORMATION APPARATUS", the entire contents of which are incorporated herein by reference.

BACKGROUND

The disclosure may relate to an image formation apparatus and may be preferably applied to, for example, an electrophotographic printer.

In a related art, an apparatus that performs a print process as follows has been in widespread use as an image formation apparatus. In the print process, image formation units for various colors form toner images by using toners of the respective colors based on an image supplied from a computer apparatus or the like and the toner images are transferred to a medium such as a paper sheet and fixed by applying heat and pressure thereto.

In recent years, there is also proposed an image formation apparatus that uses a bright toner (lustrous toner) containing a metal pigment such as aluminum to perform a print process with higher gloss than that in the case where toners containing general pigments are used (for example, Patent Document 1: Japanese Patent Application Publication No. 2018-84677, see FIG. 1). For the sake of convenience, color expressed by transferring the bright toner onto a medium such as a paper sheet is referred to as bright color.

SUMMARY

Particles of the metal pigment contained in the bright toner have a flat shape. Accordingly, in the image formation apparatus, when the layer thickness of the bright toner transferred to the paper sheet is made relatively small, the particles are in such a posture that flat surfaces thereof are nearly parallel to the sheet surface in the layer. As a result, high glossiness can be obtained.

The image formation units of the image formation apparatus each include a supply roller that supplies the toner, a development roller that forms a thin layer of toner on a peripheral side surface thereof, a charge roller that charges a photosensitive drum, the photosensitive drum that forms a toner image by attaching the toner from the development roller to an electrostatic latent image formed on a peripheral side surface of the photosensitive drum, and the like. In each image formation unit, for example, a plate shaped member referred to as development blade is pressed against the peripheral side surface of the development roller. The thickness of the thin layer of toner can be adjusted by adjusting the stiffness of the development blade, a gap between the development blade and the peripheral side surface of the development roller, and the like.

Accordingly, in the image formation apparatus, for example, reducing the gap between the development blade and the development roller in the image formation unit for the bright color and reducing the layer thickness of the bright toner formed on the surface of the development roller is conceivable. However, in this case, in the image formation unit, the metal pigment contained in the bright toner gets caught between the development blade and the development roller and removes the bright toner from the surface of the rotating development roller, thereby forming a strip shaped portion that extends in a circumferential direction and in which no bright toner is attached in some cases.

In such a case, in the image formation apparatus, a strip shaped portion (hereinafter, referred to as white strip) that extends in a conveyance direction of the sheet and in which no bright toner is attached is locally formed in a bright toner image formed by transfer of the bright toner to the paper sheet and the image quality greatly decreases.

The image formation apparatus forms not only an image using only the bright color (that is, monochrome image) but also an image obtained by superimposing the bright color and the other colors one on top of the other in some cases. Accordingly, there is a demand to improve the brightness by making the layer thickness of the bright toner as small as possible in the image formation apparatus in both cases where the image formation apparatus forms the bright color monochrome image and the image obtained by superimposing the bright color and the other colors one on top of the other.

An object of an embodiment is to provide an image formation apparatus that can provide sufficient brightness in both cases where a bright color alone is used and the bright color is used with being superimposed on other colors.

An aspect of the disclosure may be an image formation apparatus that may include: a first image formation unit that includes a first image carrier and is configured to form a first toner image on the first image carrier by using a bright toner containing a bright pigment; a second image formation unit that includes a second image carrier and configured to form a second toner image on the second image carrier by using a non-bright toner not containing the bright pigment; a transfer unit configured to transfer the first toner image and the second toner image to a transfer body; and a controller that controls the transfer unit. The controller is configured to control a transfer efficiency of the bright toner to the transfer body when the second toner image is superimposed to the first toner image on the transfer body to be lower than a transfer efficiency of the bright toner to the transfer body when the second toner image is not superimposed to the first toner image formed on the transfer body.

Another aspect of the disclosure may be an image formation apparatus that may include: a first image formation unit that includes a first image carrier and is configured to form a first toner image on the first image carrier by using a bright toner containing a bright pigment; a second image formation unit that includes a second image carrier and is configured to form a second toner image on the second image carrier by using a non-bright toner not containing the bright pigment; a transfer unit configured to transfer the first toner image and the second toner image to a transfer body; a first waste toner storage portion that is configured to store the bright toner not transferred from the first image carrier and collected from the first image carrier as a waste toner; a second waste toner storage portion that is configured to store the non-bright toner not transferred from the second image carrier and collected from the second image carrier and the bright toner collected from the transfer body as waste toners; and a controller that controls the transfer unit. The controller is configured to control a proportion of the bright toner of the first toner image to be collected as the waste toner from the first image carrier into the first waste toner storage portion such that the proportion in a case where the second toner image is superimposed to the first toner image formed on the transfer body is higher than the proportion in a case where the second toner image is not superimposed to the first toner image formed on the transfer body.

According to at least one of the above aspects, when the second toner image is not superimposed to the first toner image formed on the transfer body, the transfer efficiency is set relatively high to transfer almost all of the bright toner to the transfer body. The layer thickness of the first toner image can be reduced by collecting part of the bright toner from the transfer body in a portion other than the first image formation unit. When the second toner image is superimposed to the first toner image formed on the transfer body, the transfer efficiency set relatively low to transfer part of the bright toner to the transfer body. The layer thickness of the first toner image can be reduced by collecting a residual portion of the bright toner not transferred in the first image formation unit from the first image carrier.

Therefore, it may be possible to achieve an image formation apparatus that can provide sufficient brightness in both cases where a bright color alone is used and the bright color is used with being superimposed to other colors.

DETAILED DESCRIPTION

Figure 1:
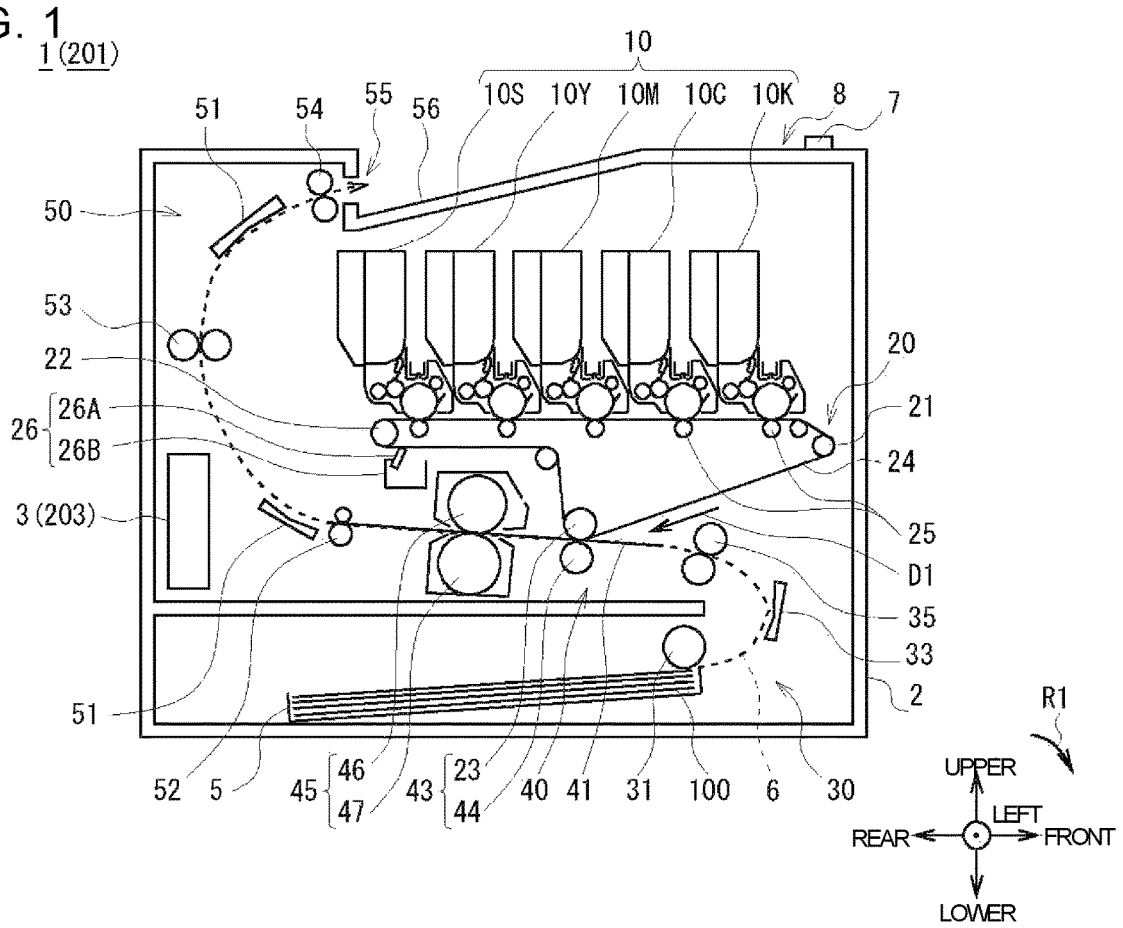
FIG. 1 is a schematic diagram illustrating an overall configuration of an image formation apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. First Embodiment

[1-1. Configuration of Image Formation Apparatus]

As illustrated in FIG. 1, an image formation apparatus 1 according to a first embodiment is an electrophotographic printer and can form (that is, print) a color image on a paper sheet 100 used as a medium. The image formation apparatus 1 does not include an image scanning function of reading originals, a communication function using a telephone line, or the like and is a single function printer (SFP) including only the printer function.

In the image formation apparatus 1, various parts are arranged in a case 2 formed in a substantially box shape. In the following description, a right end portion in FIG. 1 is defined as a front face of the image formation apparatus 1 and description is given with directions of up, down, left, right, front, and rear defined as directions as viewed in the state facing this front face.

A controller 3 integrally controls the entire image formation apparatus 1. The controller 3 is connected to a higher-level apparatus (not illustrated) such as a computer apparatus wirelessly or via a wire. When the controller 3 receives image data indicating an image to be printed and an instruction to print the image data from the higher-level apparatus, the controller 3 executes a print process of forming a print image on a surface of the paper sheet 100. A display unit 7 that displays various pieces of information and an operation unit 8 that receives user operations are provided in a front portion of an upper surface of the case 2.

Five image formation units 10K, 100, 10M, 10Y, and 10S are arranged in this order from the front side toward the rear side in an upper portion of an interior of the case 2. The image formation units 10K, 100, 10M, 10Y, and 10S correspond to colors of black (K), cyan (C), magenta (M), yellow (Y), and silver (S), respectively, and all have the same configuration, varying only in color. Silver (S) among these colors is referred also to as bright color (lustrous color). Since silver (S) contains flat metal pigment particles made of aluminum or the like and reflects light at high reflectance on flat surfaces of the particles, silver (S) is used in cases such as where an image is desired to have brightness (lustrousness) like a metal.

For the sake of explanation, the image formation units 10K, 100, 10M, 10Y, and 10S are also collectively referred to as image formation units 10 in the following description. The colors other than silver, that is the four colors of black (K), cyan (C), magenta (M), and yellow (Y) are collectively referred to as standard colors in the following description. The image formation unit 10S for silver is also referred to as first image formation unit and the image formation units 10K, 100, 10M, and 10Y for the standards colors are referred to as second image formation units.

Figure 2:
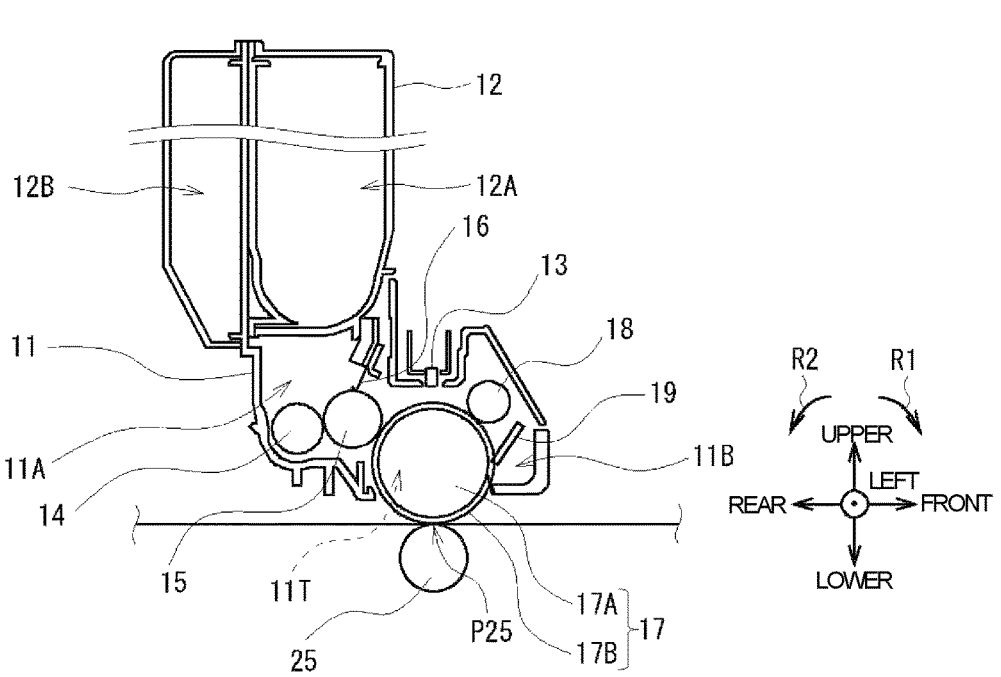
FIG. 2 is a schematic diagram illustrating a configuration of an image formation unit.

Each image formation unit 10 is also referred to as a development unit and, as illustrated in FIG. 2, includes an image formation main unit 11, a toner cartridge 12, and a light emitting diode (LED) head 13. Among these units, the LED head 13 is also referred to as an exposure device and LED chips are linearly arranged in the left-right direction in the LED head 13.

The toner cartridge 12 is provided above the image formation main unit 11 and is configured to be detachably attached to a portion near an upper end of the image formation main unit 11. In the toner cartridge 12, a toner storage portion 12A that stores an unused toner and a waste toner storage portion 12B that stores a waste toner to be disposed are provided. The toner cartridge 12 supplies the toner stored in the toner storage portion 12A to the image formation main unit 11 and also stores the waste toner collected in the image formation main unit 11 in the waste toner storage portion 12B.

For the sake of explanation, the toner storage portion 12A and the waste toner storage portion 12B of the toner cartridge 12 in the image formation unit 10S for silver are also referred to as first toner storage portion and first waste toner storage portion in the following description. The toner storage portion 12A and the waste toner storage portion 12B of the toner cartridge 12 in each of the image formation units 10K, 100, 10M, and 10Y for the standard colors are also referred to as second toner storage portion and second waste toner storage portion in the following description.

The image formation main unit 11 is provided with a supply roller 14, a development roller 15, a development blade 16, a photosensitive drum 17, a charging roller 18, and a cleaning blade 19. A main unit toner storage space 11A and a main unit waste toner storage space 11B are also formed in the image formation main unit 11. Among these parts, the supply roller 14, the development roller 15, the photosensitive drum 17, and the charging roller 18 are each formed in a columnar or cylindrical shape whose center axis extends in the left-right direction, are rotatably supported by the image formation main unit 11, and are provided with not-illustrated gears at one ends (for example, right ends) thereof. In the image formation main unit 11, a combination of parts such as the gears of the supply roller 14 and the like and other gears forms a drive transmission unit 11T that sequentially transmits drive force to the supply roller 14 and the like.

The main unit toner storage space 11A is a space located in an upper rear portion of the image formation main unit 11 and is located almost directly below the toner storage portion 12A in a state where the toner cartridge 12 is attached. The main unit toner storage space 11A stores the toner supplied from the toner storage portion 12A. Mechanisms such as a toner agitating mechanism (not illustrated) that agitates the stored toner are provided in the main unit toner storage space 11A. For the sake of explanation, the silver toner is also referred to as bright toner and the standard color toners are referred to as non-bright toners in the following description. Note that the silver toner may be referred to as lustrous toner and the standard color toners may be referred to as non-lustrous toners.

An elastic layer made of conductive urethane rubber foam or the like is formed on a peripheral side surface of the supply roller 14 and the supply roller 14 is located on the lower rear side of the main unit toner storage space 11A. An elastic layer with certain elasticity, a surface layer with certain conductivity, and the like are formed on a peripheral side surface of the development roller 15 and the development roller 15 is in contact with a front portion of the supply roller 14. The development blade 16 is made of, for example, a stainless steel plate with a predetermined thickness and a portion near a lower end thereof is in contact with a portion of the peripheral side surface of the development roller 15 near an upper end thereof with the development blade 16 slightly elastically deformed.

The photosensitive drum 17 includes a conductive supporting body 17A and a photoconductive layer 17B. The conductive supporting body 17A is, for example, an aluminum tubular member. The photoconductive layer 17B is, for example, an organic photosensitive body in which a charge generation layer and a charge transport layer are sequentially stacked on an outer peripheral surface of the conductive supporting body 17A. A portion near a lower end of the photosensitive drum 17 is exposed from a lower portion of the image formation main unit 11 and the photosensitive drum 17 is in contact with a front portion of the development roller 15. For the sake of explanation, the photosensitive drum 17 is also referred to as an image carrier, the photosensitive drum 17 in the image formation unit 10S for silver is also referred to as first image carrier, and the photosensitive drum 17 in each of the image formation units 10K, 100, 10M, and 10Y for the standard colors is also referred to as second image carrier.

The charging roller 18 has, for example, such a configuration that an outer peripheral surface of a metal tubular member is coated with a semi-conductive epichlorohydrin rubber layer, and is in contact with an upper front portion of the photosensitive drum 17. For example, the cleaning blade 19 is made of urethane rubber, formed in a thin plate shape elongating in the left-right direction, and is in contact with a lower front portion of the photosensitive drum 17. Accordingly, when the photosensitive drum 17 rotates and the toner is attached to a peripheral side surface thereof, the cleaning blade 19 can scrape off this toner. The main unit waste toner storage space 11B is located on the lower front side of the cleaning blade 19, forms a space that is substantially closed except for upper and rear portions, and temporarily stores the waste toner scraped off from the photosensitive drum 17.

The image formation main unit 11 is provided with a not-illustrated waste toner conveyor. The waste toner conveyor connects the main unit waste toner storage space 11B and the waste toner storage portion 12B of the toner cartridge 12 to each other, includes a predetermined conveyance mechanism incorporated therein, and conveys the waste toner from the main unit waste toner storage space 11B to the waste toner storage portion 12B.

The image formation main unit 11 rotates the supply roller 14, the development roller 15, and the charging roller 18 in the direction of the arrow R1 (clockwise in FIG. 2) and rotates the photosensitive drum 17 in the direction of the arrow R2 (counterclockwise in FIG. 2) by being supplied with drive force from a drive motor to be described later. The image formation main unit 11 charges the supply roller 14, the development roller 15, the development blade 16, and the charging roller 18 by applying predetermined biasing voltage to each of these parts.

The charging causes the toner in the main unit toner storage space 11A to attach to the peripheral side surface of the supply roller 14 and rotating the supply roller 14 causes the attached toner to attach to the peripheral side surface of the development roller 15. The development blade 16 removes an excessive toner from the peripheral side surface of the development roller 15 and then this peripheral side surface is brought into contact with the peripheral side surface of the photosensitive drum 17.

The charging roller 18 comes into contact with the photosensitive drum 17 in a charged state to uniformly charge the peripheral side surface of the photosensitive drum 17. The LED head 13 emits light at predetermined time intervals in a light emitting pattern based on an image data signal supplied from the controller 3 (FIG. 1) and thereby exposes the photosensitive drum 17. An electrostatic latent image is thereby formed on the peripheral side surface of the photosensitive drum 17 in a portion near the upper end thereof.

The photosensitive drum 17 is rotated in the direction of the arrow R2 to bring the portion where the electrostatic latent image is formed into contact with the development roller 15. The toner thereby attaches to the peripheral side surface of the photosensitive drum 17 based on the electrostatic latent image and a toner image based on the image data is developed. The photosensitive drum 17 is further rotated in the direction of the arrow R2 to cause the toner image to reach a portion near the lower end of the photosensitive drum 17. For the sake of explanation, a silver toner image is also referred to as first toner image and standard color toner images are also referred to as second toner images.

An intermediate transfer unit 20 is arranged below the image formation units 10 in the case 2 (FIG. 1). The intermediate transfer unit 20 is provided with a drive roller 21, a following roller 22, a secondary transfer backup roller 23, an intermediate transfer belt 24, five primary transfer rollers 25, and a belt cleaning unit 26. Among these parts, the drive roller 21, the following roller 22, the secondary transfer backup roller 23, and the primary transfer rollers 25 are all formed in columnar shapes whose center axes extend in the left-right direction.

The drive roller 21 is arranged on the lower front side of the image formation unit 10K and is rotatably supported by the case 2. When drive force from a not-illustrated motor is supplied to the drive roller 21, the drive roller 21 rotates in the direction of the arrow R1. The following roller 22 is arranged on the lower rear side of the image formation unit 10S and is rotatably supported by the case 2. Upper ends of the drive roller 21 and the following roller 22 are located at the same level or slightly below the lower ends of the photosensitive drums 17 in the respective image formation units 10. The secondary transfer backup roller 23 is arranged on the lower rear side of the drive roller 21 and the lower front side of the following roller 22 and is rotatably supported.

The intermediate transfer belt 24 as a transfer body is formed as an endless belt made of a high-resistance plastic film and is tensioned to circulate around the drive roller 21, the following roller 22, and the secondary transfer backup roller 23. In the intermediate transfer unit 20, the five primary transfer rollers 25 are arranged below a portion of the intermediate transfer belt 24 tensioned between the drive roller 21 and the following roller 22, that is at positions that are directly below the five image formation units 10 and where the primary transfer rollers 25 face the respective photosensitive drums 17 with the intermediate transfer belt 24 therebetween. The primary transfer rollers 25 are rotatably supported by the case 2 and a predetermined biasing voltage is applied to the primary transfer rollers 25.

In the following description, the primary transfer rollers 25 are also referred to as transfer units, the primary transfer roller 25 corresponding to the image formation unit 10S for silver is also referred to as first transfer unit, and the primary transfer rollers 25 corresponding to the image formation units 10K, 100, 10M, and 10Y for the standard colors are also referred to as second transfer units. In the following description, portions where the intermediate transfer belt 24 is held between the photosensitive drums 17 and the primary transfer rollers 25 are referred to as primary transfer portions P25 (FIG. 2).

The belt cleaning unit 26 is arranged on the lower front side of the following roller 22 and is formed of a cleaning blade 26A and a waste toner container 26B. The cleaning blade 26A is formed in a thin plate shape elongating in the left-right direction like the cleaning blades 19 of the image formation units 10 (FIG. 2) and is in contact with an outer peripheral surface of the intermediate transfer belt 24. Accordingly, when the intermediate transfer belt 24 travels and the toner is attached to the outer peripheral surface thereof, the cleaning blade 26A can scrape off this toner. The waste toner container 26B is located on the lower front side of the cleaning blade 26A, forms a space that is substantially closed except for part of an upper portion, and stores the waste toner scraped off from the intermediate transfer belt 24.

The intermediate transfer unit 20 rotates the drive roller 21 in the direction of the arrow R1 by using drive force supplied from a sheet conveyance motor to be described later and thereby causes the intermediate transfer belt 24 to travel in the direction of the arrow D1. The primary transfer rollers 25 rotate in the direction of the arrow R1 with the predetermined biasing voltage applied thereto. The image formation units 10 thereby transfer the toner images to the intermediate transfer belt 24 at the primary transfer portions P25 near the lower ends of the peripheral side surfaces of the photosensitive drums 17 (FIG. 2) and the toner images of the respective colors can be superimposed one on top of the other one by one. In this case, the toner images of the respective colors are superimposed one by one from silver on the upstream side, on the surface of the intermediate transfer belt 24. The intermediate transfer unit 20 causes the intermediate transfer belt 24 to travel and conveys the toner images transferred from the image formation units 10 to a portion near the secondary transfer backup roller 23.

In this case, in each image formation unit 10 (FIG. 2), the toner that is included in the toner image formed on the peripheral side surface of the photosensitive drum 17 but is not transferred to the intermediate transfer belt 24 is scraped off by the cleaning blade 19 as the waste toner and is stored in the main unit waste toner storage space 11B. Thereafter, the waste toner is conveyed to the waste toner storage portion 12B of the toner cartridge 12 by the waste toner conveyor (not illustrated) and stored therein.

A sheet cassette 5 that stores the paper sheets 100 is provided in a lowermost portion of the interior of the case 2 (FIG. 1). A sheet feeder 30 is arranged on the upper front side of the sheet cassette 5. The sheet feeder 30 includes a hopping roller 31 arranged on the upper front side of the sheet cassette 5, a conveyance guide 33 that guides each paper sheet 100 upward along a conveyance route 6 (illustrated by dotted lines in FIG. 1), registration rollers 35 that face each other with the conveyance route 6 extending therebetween, and the like. In FIG. 1, part of the conveyance guide 33 is schematically illustrated.

The sheet feeder 30 rotates the rollers as appropriate based on control of the controller 3 such that the paper sheets 100 stacked and stored in the sheet cassette 5 are picked up one by one while being separated from one another, are made to travel toward the upper front side and then turned back toward the upper rear side along the conveyance route 6 by the conveyance guide 33, and come into contact with the registration rollers 35. The rotation of the registration rollers 35 is suppressed as appropriate. By causing friction force to act on each paper sheet 100, the registration rollers 35 correct so-called skewing in which side edges of the paper sheet 100 are tilted with respect to a traveling direction, and cause the leading and trailing edges of the paper sheet 100 to extend in the left-right direction. The registration rollers 35 send the paper sheet 100 toward the rear side.

A middle conveyor 40 is arranged on the rear side of the registration rollers 35. In the middle conveyor 40, a conveyance guide 41 forms the conveyance route 6 extending substantially in the front-rear direction and a secondary transfer unit 43 is arranged in the middle of the conveyance route 6.

In the secondary transfer unit 43, the aforementioned secondary transfer backup roller 23 of the intermediate transfer unit 20 is arranged above the conveyance route 6 and a secondary transfer roller 44 is arranged below the conveyance route 6. The secondary transfer roller 44 is formed in a columnar shape whose center axis extends in the left-right direction like the secondary transfer backup roller 23 and is rotatably supported and biased upward by a not-illustrated supporting member. Specifically, in the secondary transfer unit 43, the intermediate transfer belt 24 is held (that is, nipped) between the secondary transfer backup roller 23 and the secondary transfer roller 44 from above and below on the conveyance route 6. The predetermined biasing voltage is applied to the secondary transfer roller 44. The secondary transfer unit 43 can thereby transfer the toner images on the intermediate transfer belt 24 to the paper sheet 100 and send the paper sheet 100 toward the rear side.

A fixation unit 45 is arranged on the rear side of the secondary transfer unit 43 (FIG. 1). The fixation unit 45 includes a heating roller 46 and a pressure application roller 47 arranged to face each other with the conveyance route 6 extending therebetween. The heating roller 46 as a heating unit is formed in a cylindrical shape whose center axis extends in the left-right direction, and a heater, a temperature sensor that detects temperature, and the like are provided in the heating roller 46. The pressure application roller 47 as a pressure application unit is formed in a cylindrical shape like the heating roller 46 and an upper surface of the pressure application roller 47 is pressed against a lower surface of the heating roller 46.

This fixation unit 45 heats the heating roller 46 to predetermined temperature and rotates each of the heating roller 46 and the pressure application roller 47 in a predetermined direction based on control of a fixation controller to be described later. Thus, when the fixation unit 45 receives the paper sheet 100 on which the toner images of the respective colors are transferred from the secondary transfer unit 43 and superimposed one on top of another, the fixation unit 45 causes the paper sheet 100 to be held (that is, nipped) between the heating roller 46 and the pressure application roller 47, applies heat and pressure to the paper sheet 100 to fuse the toner images to the paper sheet 100, and sends the paper sheet 100 toward the rear side.

A sheet discharger 50 is provided on the upper rear side of the fixation unit 45. The sheet discharger 50 includes a conveyance guide 51 that guides the paper sheet 100 upward along the conveyance route 6, conveyance rollers 52, 53, and 54 that face one another with the conveyance route 6 extending therebetween, and the like. The sheet discharger 50 conveys the paper sheet 100 received from the fixation unit 45 toward the upper rear side and then turns back the paper sheet 100 toward the front upper side along the conveyance route 6, and discharges the paper sheet 100 from a discharge port 55 to a discharge tray 56.

In the image formation apparatus 1, the toner images of five colors are formed by the five image formation units 10, transferred to the intermediate transfer belt 24 one by one, transferred to the paper sheet 100 in the secondary transfer unit 43, and fused by the fixation unit 45 to print a color image including silver on the paper sheet 100 in a so-called intermediate transfer method as described above.

[1-2. Circuit Configuration of Image Formation Apparatus]

Figure 3:
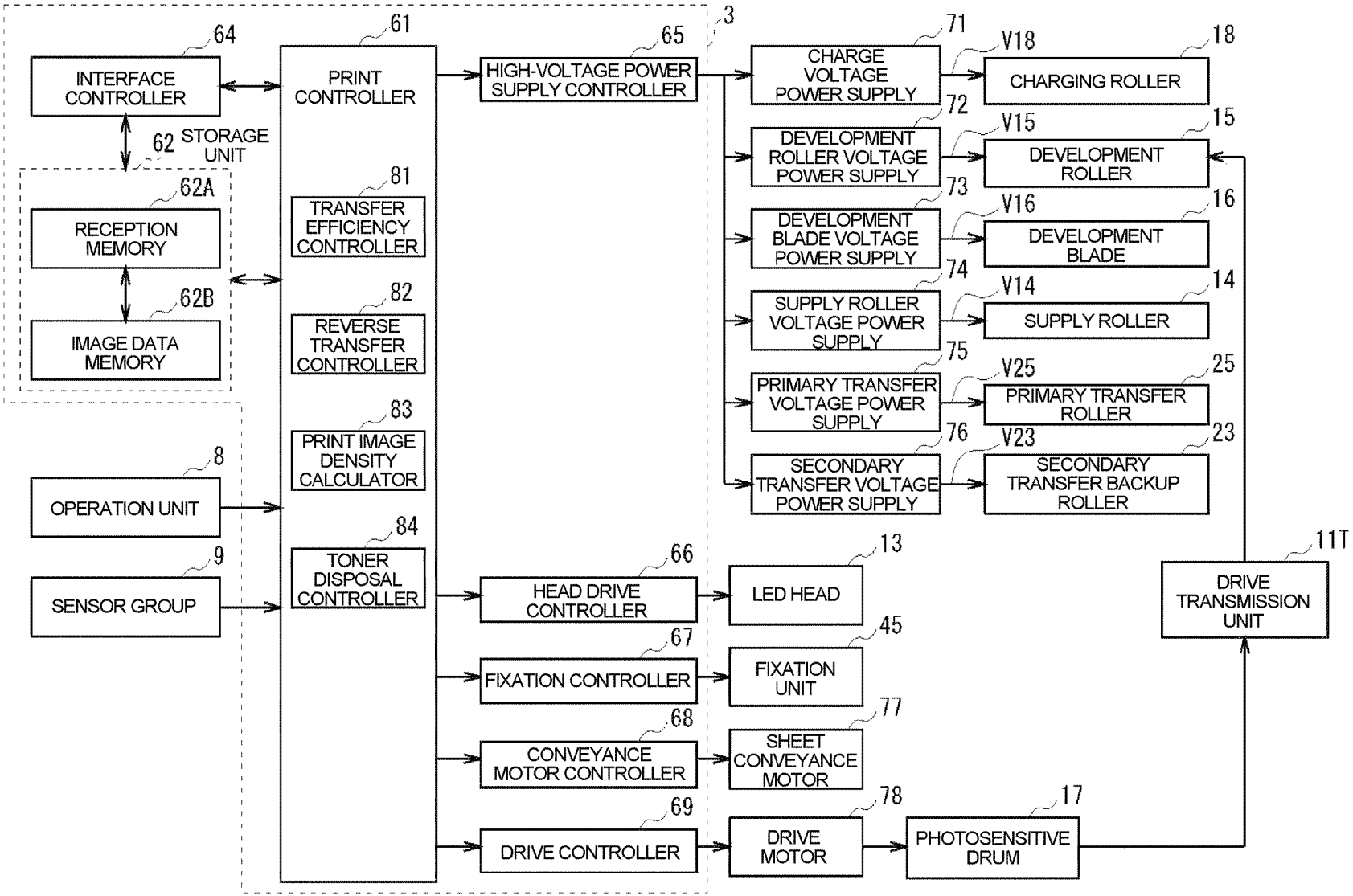
FIG. 3 is a block diagram illustrating a circuit configuration of an image formation apparatus according to a first embodiment.

A circuit configuration of the image formation apparatus 1 is described. As illustrated in FIG. 3, a circuit centered around the controller 3 is formed in the image formation apparatus 1. The controller 3 is provided with a print controller 61, a storage unit 62, an interface controller 64, a high-voltage power supply controller 65, a head drive controller 66, a fixation controller 67, a conveyance motor controller 68, a drive controller 69, and the like.

The print controller 61 includes a central processing unit (CPU) or a microprocessor, a read only memory (ROM), a random access memory (RAM), an input-output port, a timer, and the like that are not illustrated. The print controller 61 reads and executes predetermined programs from the storage unit 62 and thereby performs various processes. The print controller 61 obtains an operation signal from the operation unit 8 and obtains various detection signals from a sensor group 9. Among these units, the sensor group 9 is various sensors provided in various portions inside the image formation apparatus 1 and detects, for example, presence or absence of the paper sheet 100, temperature and humidity inside the apparatus, density of the toner in the toner image generated by each image formation unit 10, a remaining amount of the toner in each toner cartridge 12, and the like.

The storage unit 62 is, for example, a volatile storage unit such as a RAM and a non-volatile storage unit such as a flash memory and a hard disk drive, and stores various programs and various pieces of information such as setting information. The storage unit 62 includes a reception memory 62A and an image data memory 62B.

The interface controller 64 is connected to the higher-level apparatus (not illustrated) and the like via a predetermined network and the like and receives print data, a control command, and the like from the higher-level apparatus and the like to supply them to the print controller 61 or supply and store them in the reception memory 62A of the storage unit 62. The print controller 61 reads the print data stored in the reception memory 62A, performs a predetermined edit process on the read print data to generate image data, stores the image data in the image data memory 62B, and reads the image data again to supply it to the head drive controller 66.

The high-voltage power supply controller 65 is connected to a charge voltage power supply 71, a development roller voltage power supply 72, a development blade voltage power supply 73, a supply roller voltage power supply 74, a primary transfer voltage power supply 75, and a secondary transfer voltage power supply 76 and controls the voltages of power supplied from these power supplies based on commands from the print controller 61. The charge voltage power supply 71, the development roller voltage power supply 72, the development blade voltage power supply 73, the supply roller voltage power supply 74, the primary transfer voltage power supply 75, and the secondary transfer voltage power supply 76 supply power to the charging roller 18, the development roller 15, the development blade 16, the supply roller 14, the primary transfer rollers 25, and the secondary transfer backup roller 23, respectively.

In the following description, the voltages applied to the charging roller 18, the development roller 15, the development blade 16, the supply roller 14, the primary transfer rollers 25, and the secondary transfer backup roller 23 are referred to as charge voltage V18, development roller voltage V15, development blade voltage V16, supply roller voltage V14, primary transfer voltage V25, and secondary transfer voltage V23, respectively.

When the image data read from the image data memory 62B is supplied from the print controller 61, the head drive controller 66 supplies the image data to the LED head 13 and controls the LED head 13 based on a command of the print controller 61 to cause the LEDs to emit light in a light emitting pattern based on the image data. The fixation controller 67 controls rotation of the heating roller 46 and the pressure application roller 47 of the fixation unit 45 while controlling the heating roller 46 to achieve predetermined temperature based on a command of the print controller 61.

The conveyance motor controller 68 controls a sheet conveyance motor 77 based on a command of the print controller 61. In response to this, the sheet conveyance motor 77 supplies drive force to the registration rollers 35 of the sheet feeder 30 (FIG. 1), the drive roller 21 of the intermediate transfer unit 20, the conveyance rollers 52 of the sheet discharger 50, and the like.

The drive controller 69 controls a drive motor 78 based on a command of the print controller 61. In response to this, the drive motor 78 supplies drive power to the photosensitive drum 17 of each image formation unit 10 (FIG. 2). The photosensitive drum 17 supplies the drive force to the development roller 15 and the like via the drive transmission unit 11T of the image formation main unit 11.

The print controller 61 (FIG. 3) executes a predetermined print program to form therein functional blocks such as a transfer efficiency controller 81, a reverse transfer controller 82, a print image density calculator 83, and a toner disposal controller 84.

The transfer efficiency controller 81 controls transfer efficiency for each of the five image formation units 10. The transfer efficiency is a numerical value [%] representing a proportion of the toner transferred to the intermediate transfer belt 24 in the toner attached to the photosensitive drum 17 in the case where the toner image is transferred from the photosensitive drum 17 to the intermediate transfer belt 24 in the image formation unit 10, in percentage.

In other words, the transfer efficiency is obtained by considering transferability of the toner attached onto the photosensitive drum 17 (that is, developed toner) to the intermediate transfer belt 24 as efficiency and quantifying this efficiency. Thus, the smaller the numerical value of the transfer efficiency is, the poorer the transferability of the toner is, and the greater the numerical value of the transfer efficiency is, the better the transferability of the toner is.

The reverse transfer controller 82 performs control relating to reverse transfer in which the toner is transferred from the intermediate transfer belt 24 to the photosensitive drum 17 in each of the image formation units 10 (10K, 100, 10M, and 10Y) for the standard colors.

The print image density calculator 83 calculates a print image density in the generation of the toner image for each of the five image formation units 10, that is for each of the toner colors. In this description, the print image density is also referred to as print duty and is a numerical value [%] representing a proportion of pixels for which the toner is transferred to all pixels included in a printable range, in percentage.

Specifically, for example, the print image density is 100[%] when a proportion of an area (that is, area ratio) in which printing is to be performed is 100[%] such as in the case where a solid image is to be printed in the entire printable range of a predetermined region (for example, a region corresponding to one turn of the photosensitive drum, one page of a print medium, or the like). The print image density is 1[%] when printing is performed in an area corresponding to 1[%] of this printable range.

In this case, if the print image density DPD is mathematized by using the number of used dots Cm, the number of revolution Cd, and the total number of dots CO, the print image density DPD can be expressed as in the following formula (1).

[Formula 1]

$$DPD = \frac{Cm}{Cd \times CO} \times 100\ [\%] \tag{1}$$

Note that the number of used dots Cm is the number of dots actually used to form the image while the photosensitive drum 17 rotates Cd times and is the total number dots exposed by the LED head 13 (FIG. 2) during the formation of the image. The total number of dots CO is the total number of dots per one revolution of the photosensitive drum 17 (FIG. 2), that is the total number of dots potentially usable for formation of an image while the photosensitive drum 17 rotates once, irrespective of presence or absence of the exposure. In other words, the number of total dots CO is a total value of dots used in formation of a solid image in which the toner is transferred for all pixels. Accordingly, a value (Cd×CO) expresses the total value of dots potentially usable for formation of an image while the photosensitive drum 17 rotates Cd times.

The toner disposal controller 84 performs control such that a toner disposal process of disposing the toner is performed when the toner stored in the main unit toner storage space 11A of the image formation main unit 11 (FIG. 2) is agitated for a long period and is determined to be completely deteriorated.

In the toner disposal process, the toner disposal controller 84 first causes the development roller 15 to attach the toner in the main unit toner storage space 11A (FIG. 2) to the photosensitive drum 17, causes the cleaning blade 19 to scrape off this toner, and thereby stores the toner in the main unit waste toner storage space 11B. The toner disposal controller 84 causes the waste toner conveyor (not illustrated) to convey the toner stored in the main unit waste toner storage space 11B (that is, the waste toner) and store the toner in the waste toner storage portion 12B of the toner cartridge 12.

As described above, in the image formation apparatus 1, the print controller 61 of the controller 3 controls the units together with the controllers such as the high-voltage power supply controller 65 working around the print controller 61 to enable appropriate printing of an image based on the print data, the control command, and the like obtained from the higher-level apparatus.

[1-3. Manufacturing of Toner]

Description is given of manufacturing of the toner (also referred to as developer) stored in the toner cartridge 12 of the image formation unit 10 (FIG. 2). In an embodiment, description is given particularly of manufacturing of the silver toner (the bright toner), which has bright color (lustrous color).

The silver toner with a bright color contains metal particles made of aluminum or the like as a pigment as described above. In the following description, this pigment is also referred to as metal pigment or bright (lustrous) pigment. As described above, the silver toner contains the pigment made mainly of particles with a flat shape and has high brightness (so-called metallic feeling) by reflecting a large amount of light in a certain direction on flat surfaces with relatively large areas. The standard color toners contain pigments made mainly of particles with non-flat shapes. These pigment particles have shapes such as spherical, elliptical, and complex three-dimensional shapes and have no planar surfaces with relatively large areas like the flat surfaces. Accordingly, the reflectance of light is relatively low. For the sake of explanation, the silver toner is also referred to as flat pigment toner and the standard color toners are also referred to as non-flat pigment toners in the following description.

A developer generally contains, in addition to a pigment for developing a desired color, a bonding resin for bonding the pigment to a medium such as the paper sheet 100, an external additive for improving a charging property, and the like. For the sake of explanation, particles containing the pigment and the bonding resin or a powder object being an aggregation of these particles are referred to as toner or toner particles in the following description.

When the silver toner is to be manufactured, in an embodiment, an aqueous medium in which inorganic dispersant is dispersed is produced. Specifically, 920 parts by weight of industrial trisodium phosphate dodecahydrate is mixed into 27000 parts by weight of pure water and dissolved at liquid temperature of 60[° C.] and then diluted nitric acid for pH (hydrogen-ion exponent) adjustment is added to this mixture. A calcium chloride aqueous solution obtained by dissolving 440 parts by weight of industrial anhydrous calcium chloride into 4500 parts by weight of pure water is put into the aqueous solution of the trisodium phosphate dodecahydrate and is agitated at high speed for 34 minutes at revolution speed of 3566 [rpm] with a line mill (Primix Corporation) with the liquid temperature maintained at 60[° C.]. A water phase that is an aqueous medium in which a suspension stabilizer (inorganic dispersant) is dispersed is thereby prepared.

In an embodiment, a pigment dispersed oil medium is produced in a step of preparing a resin solution. Specifically, 395 parts by weight of a bright pigment (volume median diameter 5.37 [μm]) and 60 parts by weight of a charge control agent (BONTRON E-84: manufactured by Orient Chemical Industries Co., Ltd.) are mixed into 7430 parts by weight of ethyl acetate that is an organic solvent to create a pigment dispersed solution. Among these components, the bright pigment contains fine thin pieces of aluminum (Al), that is small pieces of aluminum (Al) formed in a flat plate shape, a flat shape, or a scale shape. In the following description, the bright pigment is also referred to as aluminum pigment, metal pigment, and silver toner pigment.

If the bright pigment has a volume median diameter (also referred to as mean particle diameter, mean median diameter, or pigment particle diameter) smaller than 5 [μm], the brightness of the developer is relatively low and the brightness of the image is also low. Accordingly, it is assumed that the quality of the image decreases. If the bright pigment has a volume median diameter greater than 20 [μm], the bright pigment cannot be included in toner host particles and formation of the developer is difficult. Even if the formation of the developer is possible, conveyance of the developer in the image formation apparatus 1 is difficult and it is assumed that the image cannot be appropriately formed. Thus, the bright pigment is preferably 5 [μm] or greater and 20 [μm] or smaller.

In an embodiment, 60 parts by weight of a charge control resin (FCA-726N: manufactured by Fujikura Kasei Co., Ltd.), 150 parts by weight of an ester wax (WE-4: manufactured by NOF Corporation) as a mold release agent, 1310 parts by weight of a polyester resin as a binder resin are put into the pigment dispersed solution with the liquid temperature of the pigment dispersed solution maintained at 60[° C.] and are agitated until solid objects disappear. An oil phase that is the pigment dispersed oil medium is thereby prepared.

In an embodiment, the oil phase is put into the water phase whose liquid temperature is maintained at 60[° C.], and is suspended by being agitated for 5 minutes at revolution speed of 900 [rpm] to form particles in the suspension. Ethyl acetate is removed by performing vacuum distillation on the suspension and slurry containing the developer is formed. Nitric acid is added to this slurry to adjust pH (hydrogen-ion exponent) to 1.6 or lower and the slurry is agitated. Tricalcium phosphate that is a suspension stabilizer is dissolved into this slurry and the slurry is dehydrated to form the developer. The dehydrated developer is re-dispersed into pure water and agitated to perform water cleaning. In an embodiment, a dehydrating step, a drying step, and a classification step are performed to produce the toner host particles.

In an embodiment, 1.5 [weight %] of small silica (RY200: manufactured by Nippon Aerosil Co., Ltd.), 2.29 [weight %] of colloidal silica (X24-9163A: manufactured by Shin-Etsu Chemical Co., Ltd.), 0.37 [weight %] of melamine particles (EPOSTAR S: manufactured by Nippon Shokubai Co., Ltd.) are put into the thus-produced toner host particles and mixed as an external additive step. The silver toner with high brightness can be thus obtained in an embodiment.

[1-4. Adjustment of Toner Attachment Amount]

Description is given of adjustment of a toner attachment amount (also referred to as medium attachment amount) that expresses an amount of the toner attaching to the medium such as the paper sheet 100 per unit area in the case where the image formation apparatus 1 performs the print process.

[1-4-1. Definition and Measurement of Toner Attachment Amount]

In an embodiment, weight of the toner attaching to the paper sheet 100 per unit area [mg/cm$^2$] in the case where a toner image formed in the image formation unit 10 is transferred to the intermediate transfer belt 24 and then transferred to the paper sheet 100 in the secondary transfer unit 43 is defined as the toner attachment amount.

Specifically, the toner attachment amount is obtained by measuring the weight of the toner attaching to a 1 [cm$^2$] region of a sheet surface of the paper sheet 100. Accordingly, in an embodiment, the toner attachment amount of the bright toner is measured and calculated in, for example, the following way.

First, a jig made of metal and having a flat surface shaped portion is prepared and a two-sided tape is attached to a portion with an area of 1 [cm$^2$] in the flat surface portion of the jig. The weight of the jig in this state is measured with an electronic scale (Sartorius, CAP225D) and then DC voltage of +300 [V] is applied to this jig by using an external power supply.

Figure 4:
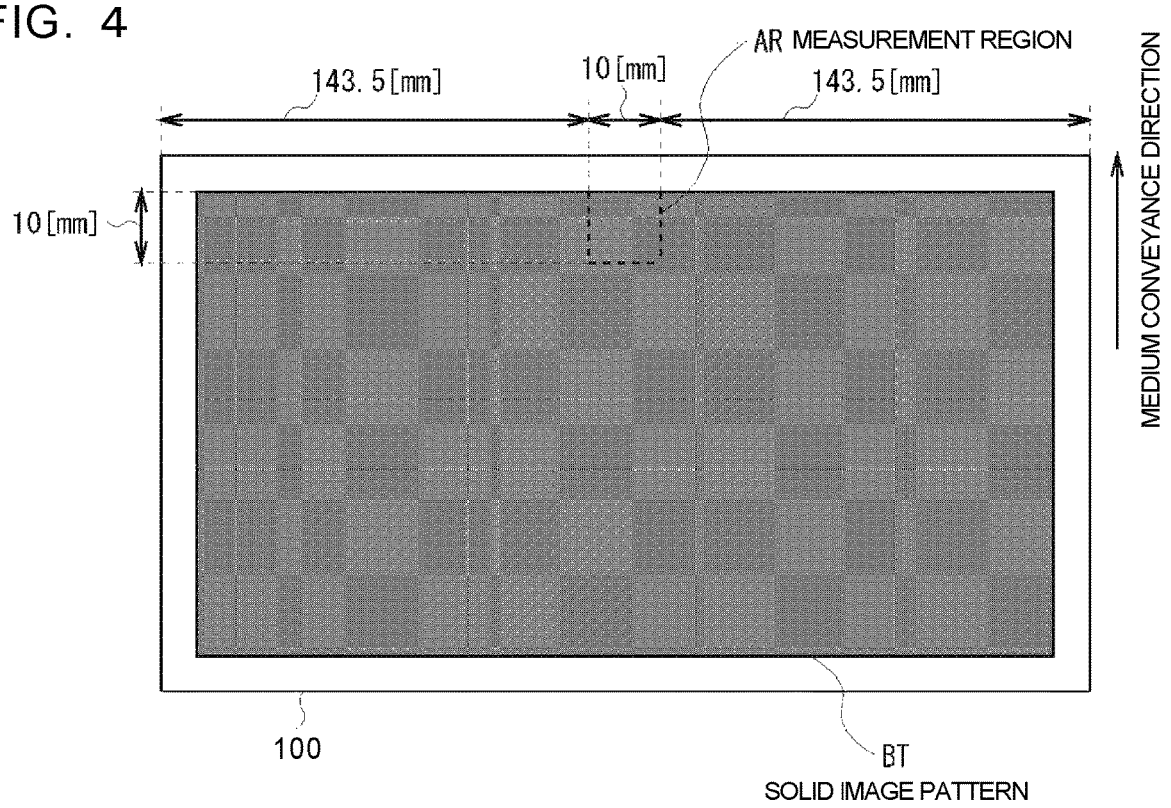
FIG. 4 is a schematic diagram illustrating a measurement region of a toner in a solid image pattern.

As illustrated in FIG. 4, a medium (that is, paper sheet 100) to which an image pattern (that is, a toner image, hereinafter, this image pattern is referred to as solid image pattern BT) is transferred at a print image density of 100[%] is prepared. The jig is pressed against a 10 [mm]-square region (hereinafter, this region is referred to as measurement region AR) of the medium once to collect the toner on the medium, the measurement region AR located substantially at the center of the medium in a main scanning direction and near the leading edge of the medium in the medium conveyance direction (that is, sub-scanning direction). The paper sheet 100 has a length of 297 [mm] in the main scanning direction (left-right direction in FIG. 4) that is the same as the length of the long side in the A4 size or the short side in the A3 size. The weight of the jig to which the toner is attached is measured again with the electronic balance. An amount of increase in the weight of the jig after the toner collection from that before the toner collection is calculated and the toner attachment amount [mg/cm$^2$] is thereby obtained.

In an embodiment, the toner attachment amount [mg/cm$^2$] of the photosensitive drum 17 is also measured and calculated in a similar method. Specifically, a silver toner image is formed on the peripheral side surface of the photosensitive drum 17 in the image formation unit 10S of the image formation apparatus 1, the toner attached to the peripheral side surface of the photosensitive drum 17 is collected and measured before the transfer of the toner image to the intermediate transfer belt 24 with the rotation of the photosensitive drum 17 stopped, and the toner attachment amount is calculated.

[1-4-2. Relationship Between Toner Attachment Amount and Voltages of Respective Parts]

The toner attachment amount of the development roller 15 is obtained while varying a difference voltage between the development roller voltage V15 and the supply roller voltage V14 in the image formation unit 10S for silver (FIG. 2) with MICROLINE C941 (manufactured by Oki Data Corporation) used as the image formation apparatus 1. As a result, a graph illustrated in FIG. 5 is obtained.

Figure 5:
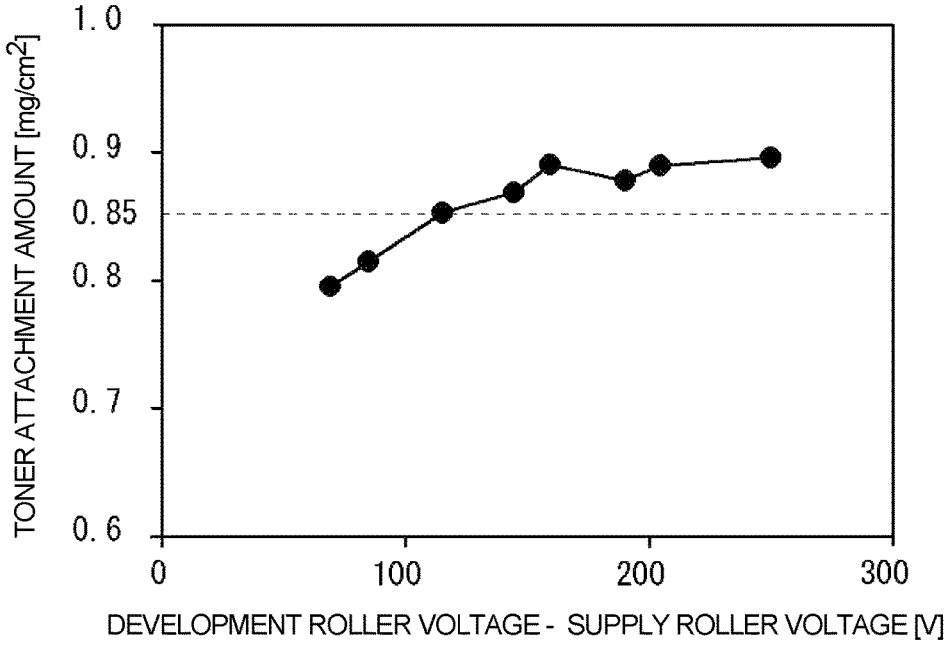
FIG. 5 is a schematic diagram illustrating a relationship between a toner attachment amount and a difference between a development roller voltage and a supply roller voltage.

The horizontal axis of FIG. 5, that is the difference between the development roller voltage V15 and the supply roller voltage V14 in the image formation unit 10S (FIG. 2) affects the degree of toner supply from the supply roller 14 to the development roller 15.

In the image formation unit 10S, if the toner supply amount from the supply roller 14 to the development roller 15 is insufficient and the layer thickness of the toner on the development roller 15 is relatively small, a gap between the outer peripheral surface of the development roller 15 and the development blade 16 is relatively small. In the image formation unit 10S, the particles of bright pigment contained in the silver toner thus get caught in this gap and, so to speak, clogging occurs. Accordingly, there is a risk that a strip shaped portion that extends in the circumferential direction and in which no toner is attached is formed on the outer peripheral surface of the development roller 15 with the rotation of the development roller 15.

In this case, in the image formation unit 10S, a strip shaped portion that extends in the circumferential direction and in which no toner is attached is also formed in a toner image formed on the outer peripheral surface of the photosensitive drum 17. In the image formation apparatus 1, a strip shaped portion that extends in the conveyance direction of the paper sheet 100 and in which no silver toner is attached, that is a so-called white strip is formed in an image transferred to the paper sheet 100 in the secondary transfer unit 43.

Accordingly, in the image formation unit 10S, the difference voltage between the development roller voltage V15 and the supply roller voltage V14 is set such that the layer of toner attaching to the peripheral side surface of the development roller 15 has a layer thickness large enough that the particles of bright pigment do not get caught, specifically, the toner attachment amount is 0.85 [mg/cm$^2$] or more (FIG. 5). When the toner attachment amount is less than 0.85 [mg/cm$^2$] in the image formation unit 10S, there is observed a state where a strip shaped portion that extends in the circumferential direction and in which no toner is attached to the peripheral side surface of the development roller 15 is formed, that is a state where a "strip" is formed. Thus, the toner attachment amount less than 0.85 [mg/cm$^2$] is evaluated to be unsuitable for the generation of the toner image.

Figure 6:
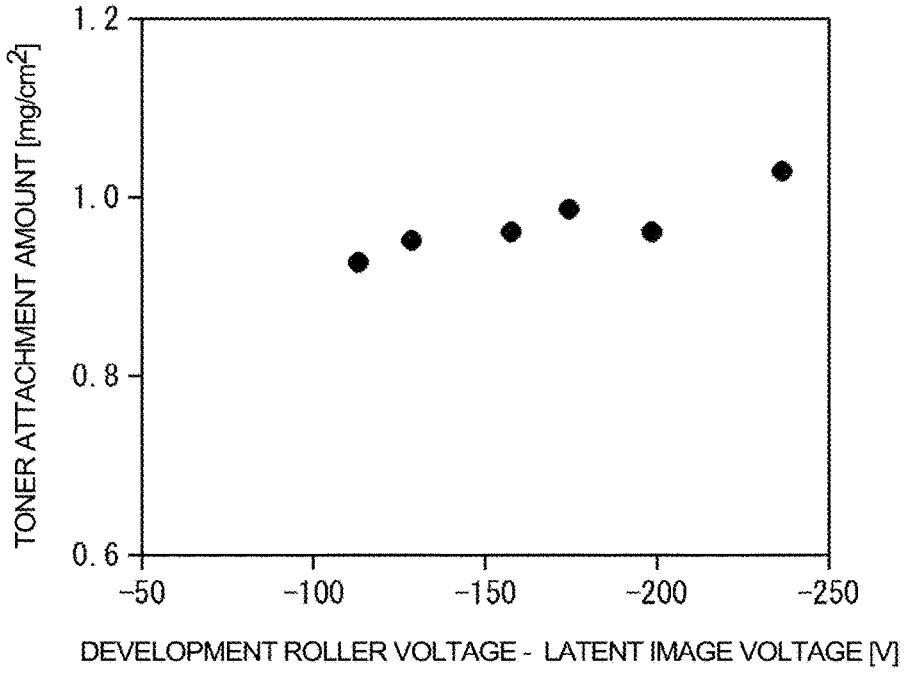
FIG. 6 is a schematic diagram illustrating a relationship between the toner attachment amount and a difference between the development roller voltage and a latent image voltage.

In the image formation unit 10S, the toner attachment amount of the photosensitive drum 17 can be increased or reduced by changing a difference voltage between the development roller voltage V15 and a voltage of a latent image portion exposed by the LED head 13 in the photosensitive drum 17 (hereinafter, referred to as latent image voltage). A relationship between the latent image voltage and the toner attachment amount on the photosensitive drum 17 in the image formation unit 10S is obtained and a graph illustrated in FIG. 6 is thereby obtained.

In the image formation unit 10S, the toner attachment amount of the development roller 15 and the toner attachment amount of the photosensitive drum 17 can be varied from each other by varying (providing a difference between) the peripheral speed (that is, traveling speed of the peripheral side surface) of the development roller 15 and the peripheral speed of the photosensitive drum 17 from each other. Accordingly, in the image formation unit 10S, the drive transmission unit 11T is adjusted such that the peripheral speed of the photosensitive drum 17 is lower (that is, slower) than the peripheral speed of the development roller 15 to make the toner attachment amount of the photosensitive drum 17 greater than the toner attachment amount of the development roller 15.

In the image formation unit 10S, the development roller voltage V15 of the development roller 15 and the latent image voltage in the photosensitive drum 17 are adjusted to predetermined voltages, respectively, to set the toner attachment amount of the photosensitive drum 17 to 1.0 [mg/cm$^2$]. In the image formation unit 10S, the toner attachment amount on the photosensitive drum 17 can be resultantly set to 1.0 [mg/cm$^2$] also by adjusting not only the development roller voltage V15 but also the voltages of the other rollers as appropriate.

Figure 7:
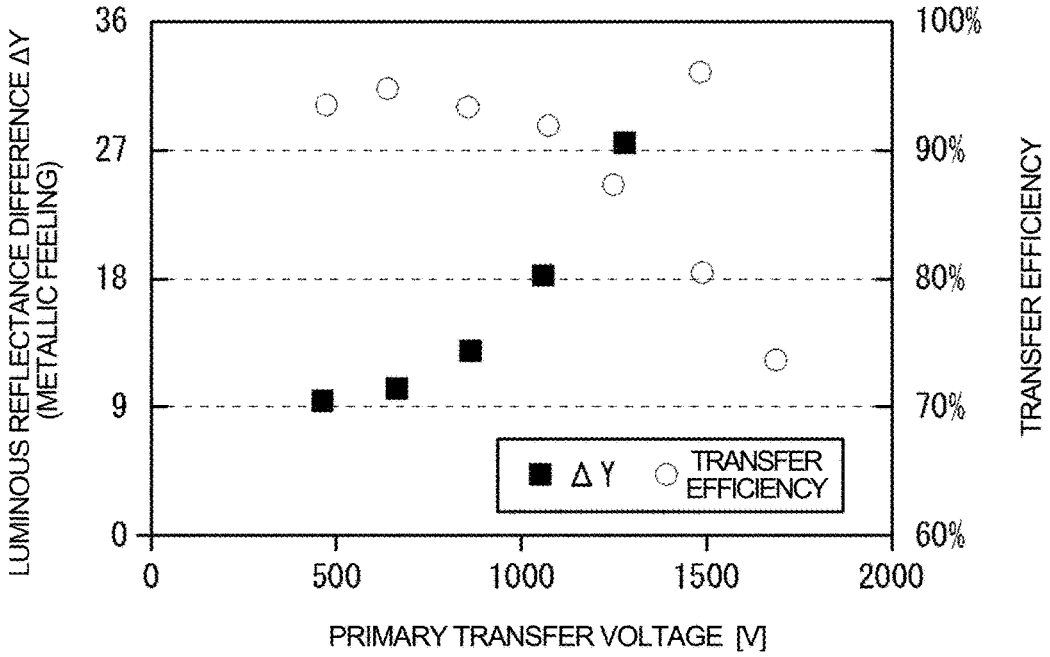
FIG. 7 is a schematic diagram illustrating relationships of a primary transfer voltage with transfer efficiency and a luminous reflectance difference.

A relationship between the primary transfer voltage V25 (hereinafter, also referred to as transfer voltage) in the image formation unit 10S of the image formation apparatus 1 and a value of a luminous reflectance difference ΔY and a relationship between the transfer voltage and the transfer efficiency (proportion of the toner transferred to the intermediate transfer belt 24 in the toner attached to the photosensitive drum 17) are obtained and a graph illustrated in FIG. 7 is obtained.

The luminous reflectance difference ΔY is a difference value obtained by using two types of luminous reflectances Y that are indices representing luminance. Specifically, the luminous reflectance difference ΔY is a difference between a luminous reflectance Y1 on the paper sheet 100 before printing (so-called white paper) and a luminous reflectance Y2 on the paper sheet 100 after the printing. The luminous reflectance difference ΔY is usable as an index representing a degree of metallic feeling (that is, glossiness like a metal) in an image printed on the paper sheet 100 by using the silver (S) toner and can be measured by using, for example, a spectrophotometer (CM-2600d, measurement diameter φ=8 [mm], manufactured by Konica Minolta, Inc.).

It is found from FIG. 7 that, in the image formation unit 10S, the transfer efficiency is the highest when the transfer voltage is about 500 [V], and decreases as the transfer voltage increases from about 500 [V]. The transfer efficiency also decreases as the transfer voltage decreases from about 500 [V].

In the image formation unit 10S, when the transfer efficiency decreases, the amount of the toner left on the photosensitive drum 17 without being transferred from the photosensitive drum 17 to the intermediate transfer belt 24, that is the waste toner scraped off by the cleaning blade 19 and eventually stored in the waste toner storage portion 12B (FIG. 2) increases. Accordingly, in the image formation unit 10S, it is generally desirable to achieve as high transfer efficiency as possible from the viewpoint of effective usage of the toner. Specifically, in the image formation unit 10S, the primary transfer voltage V25 is set to about 500 [V] as a standard. Hereinafter, this voltage is also referred to as standard voltage.

Figure 8A:
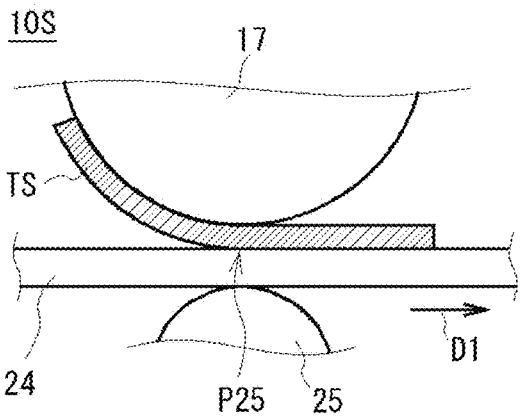
FIGS. 8A and 8B are schematic diagrams illustrating transfer of the toner in the case where the transfer efficiency is varied.

If we schematically illustrate how the image formation unit 10S of the image formation apparatus 1 transfers the toner image to the intermediate transfer belt 24, the transfer is as illustrated in FIG. 8A. Specifically, in the image formation unit 10S, the toner image is formed on the peripheral side surface of the photosensitive drum 17 by using the silver toner TS and then most of the silver toner TS is transferred to the intermediate transfer belt 24 at the primary transfer portion P25. Accordingly, in the image formation unit 10S, almost no silver toner TS is left in a portion of the photosensitive drum 17 having passed the primary transfer portion P25.

In FIG. 7, the value of luminous reflectance difference ΔY, that is the metallic feeling increases when the transfer voltage increases from about 500 [V]. This assumed to be due to the following reason.

Specifically, in the image formation unit 10S for silver, when the transfer voltage increases from about 500 [V], the transfer efficiency decreases and this causes the layer thickness of the toner image transferred to the intermediate transfer belt 24 to decrease (that is, the toner image becomes thinner). Then, on the paper sheet 100 on which this toner image is printed, a proportion of the flat bright pigment particles whose flat surfaces form small angles with respect to (that is, are nearly parallel to) the sheet surface increases and reflectance of light increases.

Based on such a relationship, a method in which the transfer voltage (that is, primary transfer voltage V25) is increased to intentionally reduce the transfer efficiency and the luminous reflectance difference ΔY (metallic feeling) is thereby resultantly increased is conceivable in the image formation unit 10S.

Figure 8B:
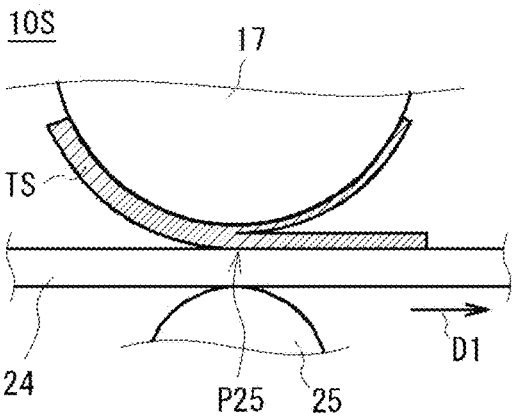

Specifically, in the image formation unit 10S, as illustrated in FIG. 8B corresponding to FIG. 8A, the toner image is formed on the peripheral side surface of the photosensitive drum 17 by using the silver toner TS and then part of the silver toner TS is transferred to the intermediate transfer belt 24 at the primary transfer portions P25 while the rest of the silver toner TS is left on the photosensitive drum 17 side. The toner image (FIG. 8B) transferred to the intermediate transfer belt 24 at the reduced transfer efficiency has smaller layer thickness (is thinner) than the toner image (FIG. 8A) transferred to the intermediate transfer belt 24 at the standard transfer efficiency.

However, in this case, in the image formation unit 10S for silver, the silver toner TS left on the photosensitive drum 17 is scraped off by the cleaning blade 19 (FIG. 2) as the waste toner and is eventually stored in the waste toner storage portion 12B of the toner cartridge 12. In other words, in the image formation unit 10S for silver, when the transfer efficiency is reduced, the amount of the waste toner to be stored (to be collected) in the waste toner storage portion 12B increases.

[1-4-3. Reduction of Toner Attachment Amount by Reverse Transfer]

In the image formation apparatus 1, there is a method called reverse transfer in which the toner image is transferred to the intermediate transfer belt 24 in an image formation unit 10 located upstream in the traveling direction of the intermediate transfer belt 24 and then the toner is transferred from the intermediate transfer belt 24 to the photosensitive drums 17 in the other image formation units 10 located downstream.

The image formation apparatus 1 can reverse-transfer part of the toner image attached onto the intermediate transfer belt 24 in the downstream image formation units 10 by using this reverse transfer and thereby make the layer thickness of the toner image left on the intermediate transfer belt 24 relatively small.

In this section, printing of a silver monochrome image on the paper sheet 100 with the image formation apparatus 1 is described by giving, as an example, the case where the toner image is transferred to the intermediate transfer belt 24 in the image formation unit 10S for silver and then part of the toner image is reverse-transferred to the photosensitive drum 17 in the image formation unit 10Y for yellow.

Figure 9A:
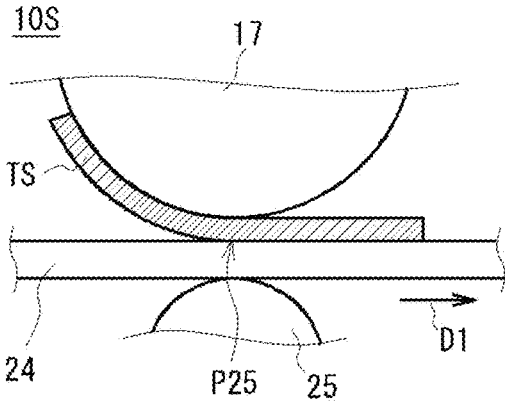
FIGS. 9A and 9B are schematic diagrams illustrating transfer and reverse transfer of the toner.

As illustrated in FIG. 9A corresponding to FIG. 8A, the image formation apparatus 1 forms a silver toner image on the peripheral side surface of the photosensitive drum 17 in the upstream image formation unit 10S and then transfers the toner image to the intermediate transfer belt 24 at the standard transfer efficiency. The toner image of the silver toner TS with a relatively large layer thickness (that is, thick) is thereby formed on the intermediate transfer belt 24, downstream of the primary transfer portion P25.

Figure 9B:
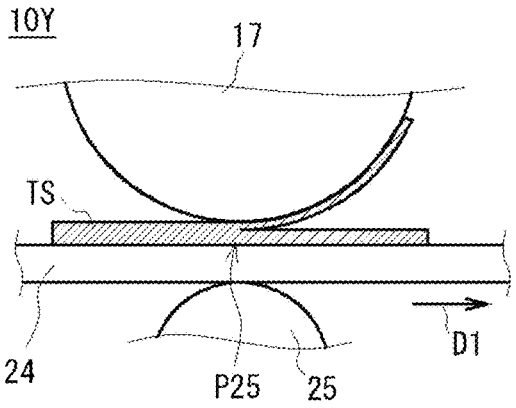

As illustrated in FIG. 9B, the image formation apparatus 1 adjusts the primary transfer voltage V25 applied to the primary transfer roller 25 and transfers (that is, reverse-transfers) part of the toner image of the silver toner TS on the intermediate transfer belt 24 to the photosensitive drum 17 side in the image formation unit 10Y located downstream of the image formation unit 10S.

In the image formation unit 10Y for yellow, the silver toner TS reverse-transferred to the photosensitive drum 17 at the primary transfer portion P25 is scraped off by the cleaning blade 19 as the waste toner and is conveyed and stored in the waste toner storage portion 12B of the toner cartridge 12. As a result, the toner image of the silver toner TS with a relatively small layer thickness (that is, thin) is left on the intermediate transfer belt 24, downstream of the primary transfer portion P25 in the image formation unit 10Y.

Specifically, the image formation apparatus 1 can form the toner image of the silver toner TS with a relatively small layer thickness (thin) while storing almost no waste toner in the waste toner storage portion 12B in the image formation unit 10S for silver, by performing the reverse transfer in the downstream image formation unit 10.

[1-4-4. Print Process]

The image formation apparatus 1 cannot simultaneously perform the aforementioned reverse transfer and the transfer of the standard color toner images, formed on the peripheral side surfaces of the photosensitive drums 17 in the image formation units 10 for the standard colors, to the intermediate transfer belt 24 (hereinafter, this transfer is referred as normal transfer). This is because, in the image formation units 10 for the standard colors, the primary transfer voltage V25 is switched to a voltage suitable for the normal transfer or a voltage suitable for the reverse transfer and both voltages cannot be simultaneously applied in principle.

Accordingly, the image formation apparatus 1 performs the reverse transfer in the image formation units 10 for the standard colors (colors other than silver) when a monochrome image using only silver is printed, and reduces the transfer efficiency in the image formation unit 10S for silver when color printing of printing an image using a combination of silver and other colors is performed. Specifically, in the image formation apparatus 1, the method of adjusting the toner attachment amount is switched depending on the type of color used in the image data.

Figure 10:
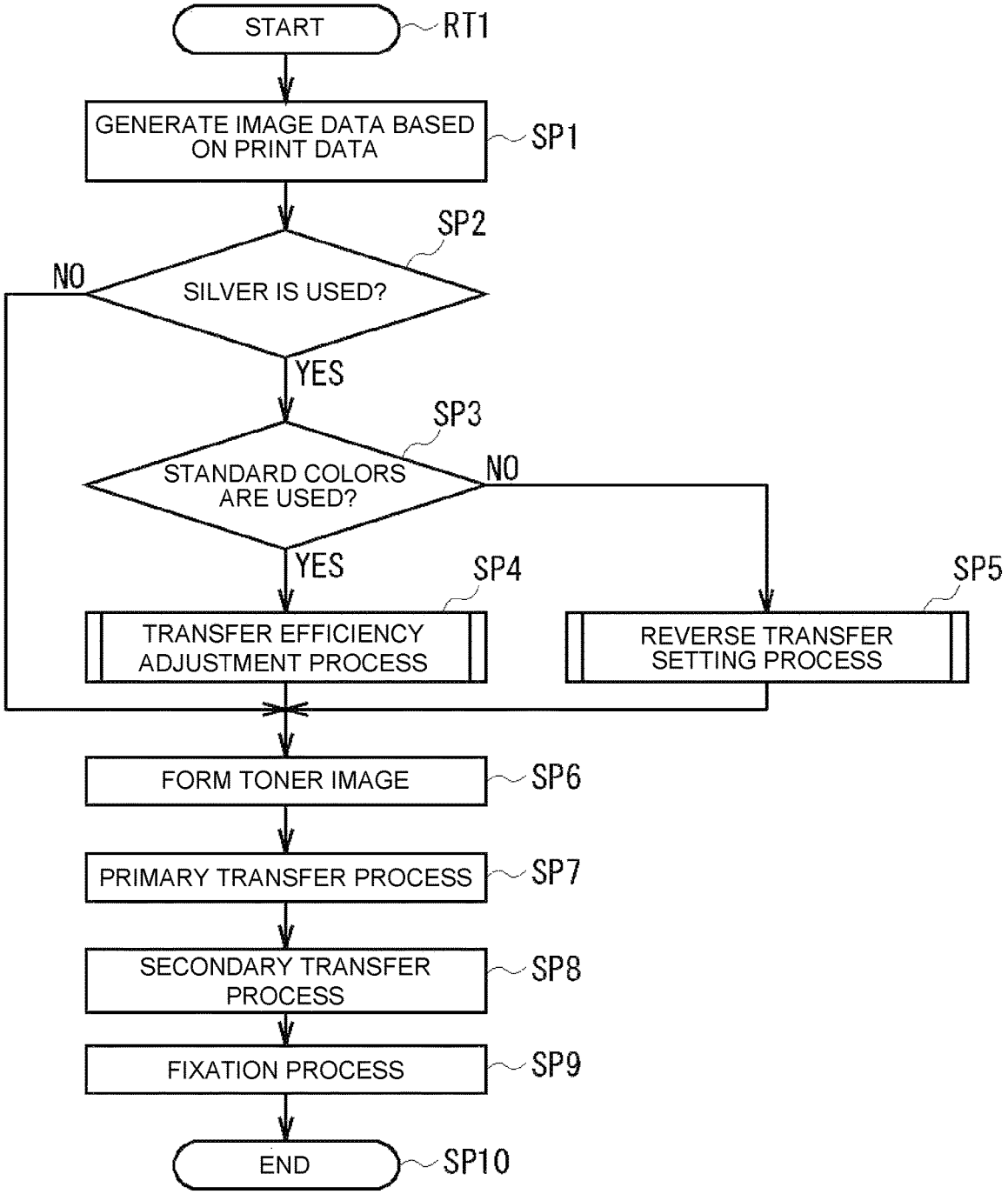
FIG. 10 is a flow diagram illustrating a print process procedure.

Specifically, in the case of performing the print process, the print controller 61 of the image formation apparatus 1 (FIG. 3) reads the print program from the storage unit 62 and executes it when receiving the print data, the control command, and the like from the not-illustrated higher-level apparatus to start a print process procedure RT1 illustrated in FIG. 10 and proceeds to the first step SP1.

In step SP1, the print controller 61 generates the image data based on the print data, stores the image data in the image data memory 62B (FIG. 3), and proceeds to subsequent step SP2. In step SP2, the print controller 61 determines whether silver is used in the image data. When an affirmative result is obtained in this step, this means that a process for reducing the layer thickness of the silver toner image (making the silver toner image thin) needs to be performed. In this case, the print controller 61 proceeds to subsequent step SP3.

In step SP3, the print controller 61 determines whether any standard color other than silver is used in the image data, that is whether the image data includes at least one of black, cyan, magenta, and yellow. When an affirmative result is obtained in this step, the image formation unit 10 for the included color located downstream cannot perform the reverse transfer process in a subsequent primary transfer process and this means that the transfer efficiency needs to be reduced in the primary transfer process for silver. In this case, the print controller 61 proceeds to subsequent step SP4.

In step SP4, the print controller 61 performs the process for reducing the transfer efficiency in the image formation unit 10S for silver and proceeds to subsequent step SP6. Specifically, the print controller 61 causes the transfer efficiency controller 81 and the high-voltage power supply controller 65 (FIG. 3) to perform control of setting the primary transfer voltage V25 supplied from the primary transfer voltage power supply 75 to the primary transfer rollers 25 of the image formation unit 10S to a voltage (for example, about 1600 [V] or the like) higher than the standard voltage (about 500 [V]).

When a negative result is obtained in step SP3, this means that the image formation units 10 for the respective colors located downstream can perform the reverse transfer process in the subsequent primary transfer process. In this case, the print controller 61 proceeds to subsequent step SP5 to perform a setting process necessary for the reverse transfer process.

In step SP5, the print controller 61 performs a reverse transfer setting process as a sub-routine. Specifically, the print controller 61 starts a reverse transfer setting process procedure RT2 illustrated in FIG. 11 and proceeds to step SP21. In step SP21, the print controller 61 causes the high-voltage power supply controller 65 (FIG. 3) to perform control of setting the primary transfer voltage V25 supplied from the primary transfer voltage power supply 75 to the image formation unit 10S for silver to the standard voltage (about 500 [V]) and proceeds to subsequent step SP22.

Specifically, the print controller 61 controls the absolute value of the primary transfer voltage V25 supplied to the image formation unit 10S for silver such that the value (500 [V]) in the case where the silver toner image and the standard color toner images are not superimposed one on top of another on the intermediate transfer belt 24 is smaller than the value (1600 [V]) in the case where the toner images are superimposed one on top of another.

In step SP22, the print controller 61 causes the reverse transfer controller 82 and the high-voltage power supply controller 65 (FIG. 3) to perform control of setting the primary transfer voltage V25 supplied from the primary transfer voltage power supply 75 to each of the image formation units 10K, 100, 10M, and 10Y for the standard colors to a predetermined reverse transfer voltage and proceeds to subsequent step SP23. The value of the reverse transfer voltage is the same for all standard colors. In step SP23, the print controller 61 terminates the reverse transfer setting process procedure RT2, returns to the original print process procedure RT1 (FIG. 10), completes step SP5, and proceeds to subsequent step SP6.

When a negative result is obtained in step SP2, silver is not used in the image data and this means that there is no need to perform the process for adjusting the toner attachment amount of silver. In this case, the print controller 61 proceeds to subsequent step SP6.

In step SP6, the print controller 61 causes the head drive controller 66 to supply the image data to the LED head 13 for each color, causes the drive controller 69 to drive the drive motor 78, and performs other similar operations to form a toner image on the peripheral side surface of the photosensitive drum 17 with each image formation unit 10. The print controller 61 proceeds to subsequent step SP7.

In step SP7, the print controller 61 performs the primary transfer process of transferring the toner image from the photosensitive drum 17 of the image formation unit 10 to the intermediate transfer belt 24 for each color and proceeds to subsequent step SP8. When silver and the standard colors are used in the image data, the transfer efficiency is reduced in the image formation unit 10S for silver. When only silver is used in the image data, the image formation units 10K, 100, 10M, and 10Y for the standard colors reverse-transfer the silver toner from the intermediate transfer belt 24 to the photosensitive drums 17.

In step SP8, the print controller 61 transfers the toner images from the intermediate transfer belt 24 to the paper sheet 100 in the secondary transfer unit 43 and proceeds to subsequent step SP9. In step SP9, the print controller 61 performs a fixing process of fixing the toner images to the paper sheet 100 with the fixation unit 45 and then proceeds to subsequent step SP10 to terminate the print process procedure RT1.

[1-5. Effects and the Like]

In the aforementioned configuration, when the image formation apparatus 1 according to a first embodiment prints image data using silver, the image formation apparatus 1 reduces the layer thickness of silver in toner images transferred to the paper sheet 100 by using different methods depending on whether the other colors are used in the image data or not. The image formation apparatus 1 can thereby increase the proportion of the flat bright pigment particles that are contained in the silver toner and whose flat surfaces are in a posture nearly parallel to the sheet surface in an image eventually printed on the paper sheet 100 and achieve a state where the image reflects light in an excellent manner and has high brightness.

Specifically, when silver and the other colors are used in the image data, the image formation apparatus 1 reduces the transfer efficiency in the transfer of the toner image from the photosensitive drum 17 to the intermediate transfer belt 24 in the image formation unit 10S for silver. The image formation apparatus 1 thus transfers only part of the toner image from the photosensitive drum 17 to the intermediate transfer belt 24 in the image formation unit 10S for silver. Accordingly, the layer thickness of the silver toner image formed on the intermediate transfer belt 24 can be made relatively small (the silver toner image can be made thin).

In this case, the image formation apparatus 1 does not perform a special process such as the reverse transfer in the image formation units 10K, 10C, 10M, and 10Y for the other colors. Accordingly, the toner images of the other colors can be appropriately transferred to the intermediate transfer belt 24 and a preferable image can be printed on the paper sheet 100.

However, in this case, in the image formation unit 10S for silver, the toner not transferred from the photosensitive drum 17 to the intermediate transfer belt 24 becomes the waste toner and is eventually stored in the waste toner storage portion 12B of the toner cartridge 12 (FIG. 2). Accordingly, in the image formation apparatus 1, when the process of reducing the transfer efficiency is performed many times in the image formation unit 10S for silver, there is a possibility that the waste toner storage portion 12B becomes full and the toner cartridge 12 needs to be replaced, even though unused toner is still left in the toner storage portion 12A of the toner cartridge 12. In other words, in the image formation apparatus 1, there is a risk of wasteful disposal of usable silver toner.

Accordingly, in the image formation apparatus 1, when only silver is used in the image data, the transfer efficiency is not reduced in the image formation unit 10S for silver and the reverse transfer is performed in the image formation units 10K, 10C, 10M, and 10Y for the other colors. Specifically, the image formation apparatus 1 transfers most of the toner image from the photosensitive drum 17 to the intermediate transfer belt 24 at the normal transfer efficiency in the image formation unit 10S for silver and then reverse-transfers part of the toner image to the photosensitive drums 17 in the downstream image formation units 10K, 100, 10M, and 10Y for the other colors.

In the image formation apparatus 1, the waste toner in a portion, of the silver toner image formed in the image formation unit 10S for silver, that is not eventually left on the intermediate transfer belt 24 can be thereby stored in the waste toner storage portions 12B of the image formation units 10K, 100, 10M, and 10Y for the other colors. In other words, in the image formation apparatus 1, it is possible to reduce the layer thickness of the silver toner image formed on the intermediate transfer belt 24 (make the silver toner image thinner) without hardly increasing the storage amount of the waste toner in the waste toner storage portion 12B of the image formation unit 10S for silver.

Specifically, in the image formation apparatus 1, it is difficult to reduce the layer thickness of the toner attached to the development roller 15 from the viewpoint of preventing clogging of the bright pigment between the development roller 15 and the development blade 16 in the image formation unit 10S for silver (FIG. 2) and preventing generation of a white strip in an eventually printed image. In the image formation apparatus 1, if the transfer efficiency is constantly reduced in the image formation unit 10S for silver, the waste toner storage portion 12B of the toner cartridge 12 quickly becomes full. Thus, even if the unused toner is left in the toner storage portion 12A, the toner cartridge 12 is replaced and the toner is wasted.

Accordingly, in the image formation apparatus 1, when the image data is silver monochrome image data, the silver toner is reverse-transferred from the intermediate transfer belt 24 in the image formation units 10K, 100, 10M, and 10Y for the colors other than silver and the storage destination of the waste toner can be thereby distributedly set to the waste toner storage portions 12B for the other colors. From another viewpoint, since the transfer efficiency does not have to be reduced in the image formation units 10K, 100, 10M, and 10Y for the colors other than silver, the amounts of the waste toners of the other colors stored in the waste toner storage portions 12B are not necessarily large. Thus, the waste toner storage portions 12B have sufficient free spaces and can be effectively used by storing the silver waste toner.

As illustrated in FIG. 7, in the image formation unit 10S for silver, the transfer efficiency can be reduced by either increasing or reducing the transfer voltage from the standard voltage (about 500 [V]) and this can resultantly improve the luminous reflectance difference ΔY (that is, metallic feeling). In the image formation apparatus 1, the transfer efficiency is reduced by increasing the transfer voltage from the standard voltage in consideration of the properties of the silver toner.

Since the silver toner contains metal pigment that is a conductive body, the silver toner has such properties that the charge property is lower than those of the toners of the other colors and is difficult to transfer by using high voltage. Accordingly, in the image formation apparatus 1, when the secondary transfer unit 43 transfers the toner images from the intermediate transfer belt 24 to the paper sheet 100 with the silver toner image and the toner images of the other colors superimposed one on top of another on the intermediate transfer belt 24, efficient transfer of the silver toner like the toners of the other colors may be difficult.

Thus, in the image formation apparatus 1, the transfer voltage is increased from the standard voltage in the image formation unit 10S for silver to reduce the transfer efficiency and improve the luminous reflectance difference ΔY as well as to increase the charge amount in the silver toner and bring it close to the charge amounts in the toners of the other colors. In the image formation apparatus 1, preferable transfer of the silver toner to the paper sheet 100 like the toners of the other colors can be thereby expected in the secondary transfer unit 43.

According to the configuration described above, in the printing of image data using silver, the image formation apparatus 1 according to a first embodiment reduces the transfer efficiency in the image formation unit 10S for silver when the standard colors are used in the image data, and reverse-transfers the toner in the image formation units 10K, 100, 10M, and 10Y for the standard colors when the standard colors are not used. The image formation apparatus 1 can thereby reduce the layer thickness in the silver toner image without generating a white strip and improve brightness in an image eventually printed on the paper sheet 100 while distributing the silver waste toner to the waste toner storage portion 12B for silver or those for the standard colors.

2. Second Embodiment

[2-1. Configuration of Image Formation Apparatus]

Figure 12:
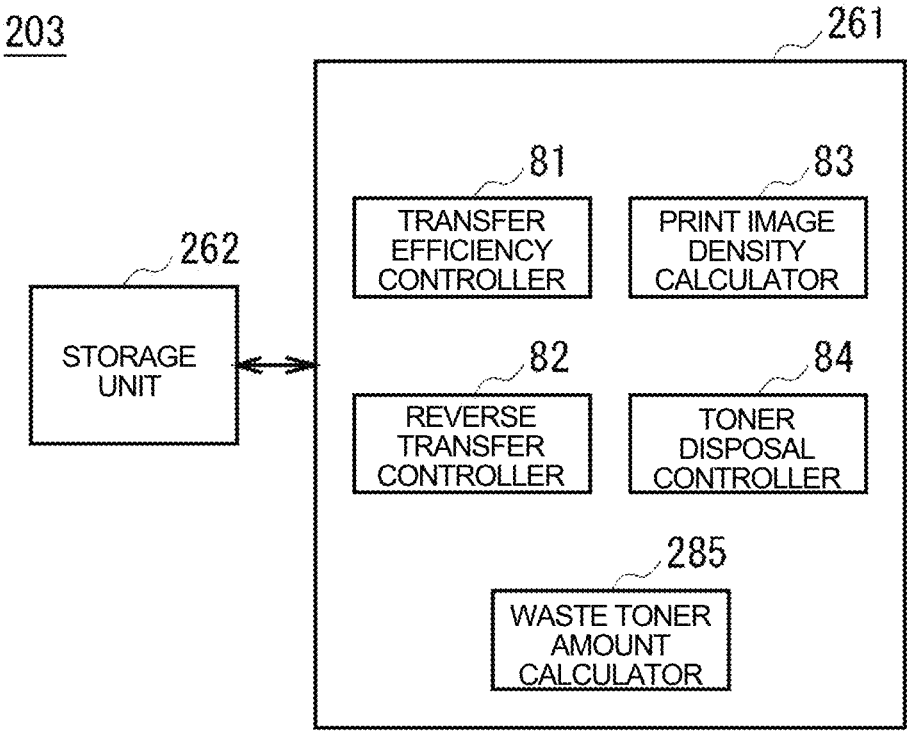
FIG. 12 is a block diagram illustrating a circuit configuration of a controller according to a second embodiment.

An image formation apparatus 201 (FIG. 1) according to a second embodiment is different from the image formation apparatus 1 according to a first embodiment in that the image formation apparatus 201 includes a controller 203 instead of the controller 3, but is configured to be the same in the other points. As illustrated in FIG. 12 partially corresponding to FIG. 3, the controller 203 is different from the controller 3 according to a first embodiment in that the controller 203 includes a print controller 261 and a storage unit 262 instead of the print controller 61 and the storage unit 62, but is configured to be the same in the other points.

Like the print controller 61 according to a first embodiment, the print controller 261 includes a not-illustrated CPU and the like and executes various processes by reading predetermined programs from the storage unit 262 and executing them. However, the print controller 261 performs processes that are partially different from those of a first embodiment. Like the storage unit 62 according to a first embodiment, the storage unit 262 stores various pieces of information but stores programs that are partially different from those of a first embodiment.

The print controller 261 executes a predetermined print program to form therein functional blocks such as a waste toner amount calculator 285 in addition to the transfer efficiency controller 81, the reverse transfer controller 82, the print image density calculator 83, and the toner disposal controller 84 as in a first embodiment.

The waste toner amount calculator 285 calculates an amount of the waste toner stored in the main unit waste toner storage space 11B for each toner color. Specifically, the waste toner amount calculator 285 calculates the waste toner amount W(n) [$cm^3$] for each toner color (that is, for each image formation unit 10) according to the following formula (2) by using a transfer residual toner amount Wtr, a toner disposal amount Wf, a fogging toner amount Wb, and a reverse transfer toner amount Wr. Note that a sign "n" can be replaced by a letter representing color (for example, S, K, C, M, Y, and the like).

[Formula 2]

$$W(n)=Wtr+Wf+Wb+(1-DPD)\times Wr \quad (2)$$

The transfer residual toner amount Wtr in the formula (2) represents the amount [$cm^3$] of transfer residual toner that is not transferred from the photosensitive drum 17 to the intermediate transfer belt 24 when the print process is performed. The transfer residual toner amount Wtr is calculated from the following formula (3) by using a coefficient A set for each toner color, the print image density DPD obtained from the formula (1), and a volume conversion coefficient V set for each toner color.

[Formula 3]

$$Wtr=A\times DPD\times V \quad (3)$$

The toner disposal amount Wf of the formula (2) represents an amount [$cm^3$] of toner disposed when the aforementioned toner disposal process is performed. The toner disposal amount Wf is calculated from the following formula (4) by using the print image density DPD in the case where the toner disposal process is performed and the volume conversion coefficient V set for each toner color.

[Formula 4]

$$Wf=DPD\times V \quad (4)$$

The fogging toner amount Wb of the formula (2) represents an amount [$cm^3$] of toner that is transferred to the paper sheet 100 by attaching to a portion of the toner image where the toner should not be transferred. The fogging toner amount Wb is calculated from the following formula (5) by using a coefficient B set for each toner color, the number of revolution Cd of the photosensitive drum 17, and the volume conversion coefficient V set for each toner color.

[Formula5]

$$Wb=B\times RD\times V \quad (5)$$

The reverse transfer toner amount Wr in the formula (2) represents an amount [$cm^3$] of part of the toner that is transferred to the intermediate transfer belt 24 by the image formation unit 10 located upstream in the traveling direction of the intermediate transfer belt 24 and then transferred (that is, reversed transferred) from the intermediate transfer belt 24 to the photosensitive drum 17 in the image formation unit 10 located downstream. The reverse transfer toner amount Wr is calculated from the following formula (6) by using a collection ratio C set for each toner color and a print image densities DPDu and a volume conversion coefficient Vu in each upstream image formation unit 10.

[Formula 6]

$$Wr=\Sigma(C\times DPDu\times Vu) \quad (6)$$

The print image density DPD in the formula (2) represents the print image density DPD of the toner color (that is, the image formation unit 10) for which the waste toner amount W(n) is calculated.

The waste toner amount calculator 285 calculates the waste toner amount W(n) for each toner color according to the formula (2) and the like every time the print process, the toner disposal process, or the like is performed, and stores the latest waste toner amount W(n) in the storage unit 262, that is updates the waste toner amount W(n) as needed. When the toner cartridge 12 (FIG. 2) is replaced, the waste toner amount calculator 285 initializes the value of the waste toner amount W(n) to "0".

[2-2. Print Process]

The print controller 261 of the image formation apparatus 201 executes the print process according to the print process procedure RT1 (FIG. 10) as in the image formation apparatus 1 according to a first embodiment. However, in step SP5, the print controller 261 performs a reverse transfer setting process different from that in a first embodiment.

Figure 11:
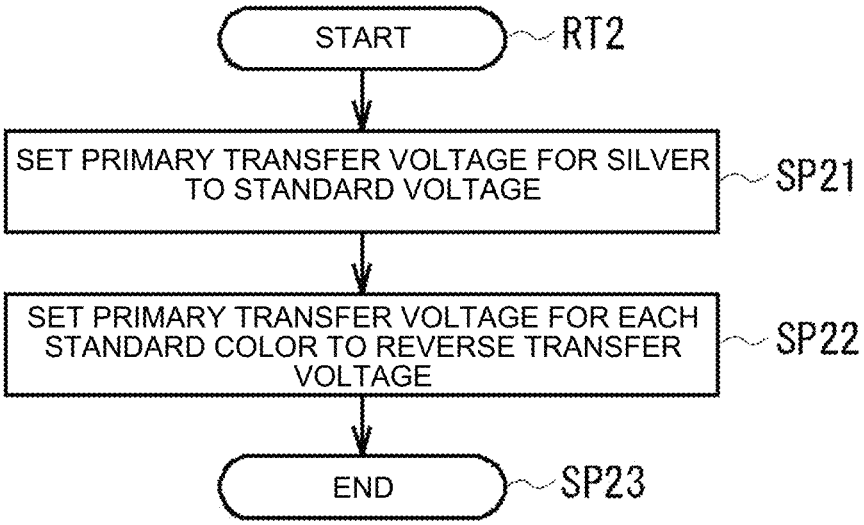
FIG. 11 is a flow diagram illustrating a reverse transfer setting process procedure according to a first embodiment.
Figure 13:
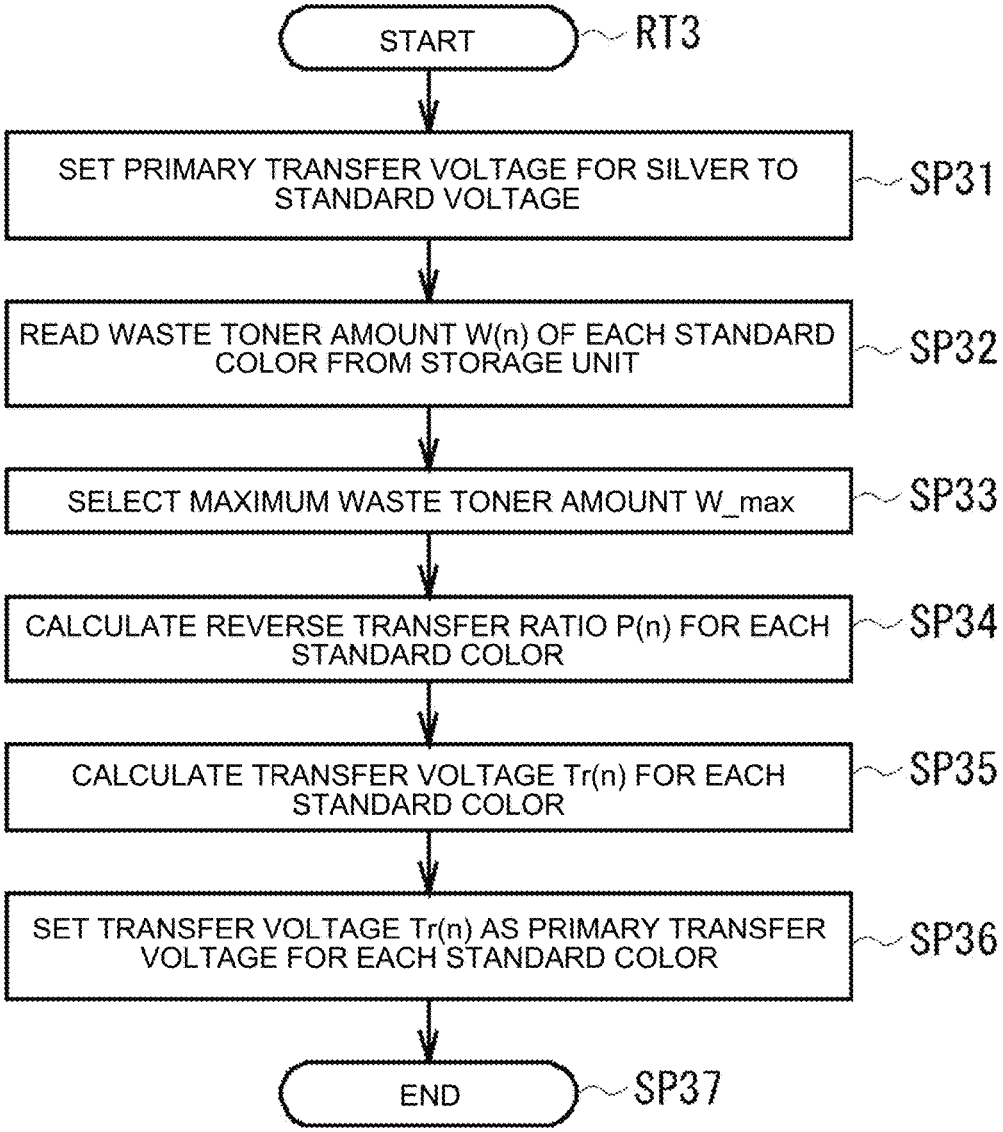
FIG. 13 is a flow diagram illustrating a reverse transfer setting process procedure according to a second embodiment.

Specifically, the print controller 261 starts a reverse transfer setting process procedure RT3 illustrated in FIG. 13 corresponding to FIG. 11 and proceeds to step SP31. In step SP31, the print controller 261 causes the high-voltage power supply controller 65 (FIG. 1) to perform control of setting the primary transfer voltage V25 supplied from the primary transfer voltage power supply 75 to the image formation unit 10 for silver to the standard voltage (about 500 [V]) as in step SP21 (FIG. 11) and proceeds to subsequent step SP32.

In step SP32, the print controller 261 reads the waste toner amounts W(n) of the respective standard colors (colors other than silver) from the storage unit 262 and proceeds to subsequent step SP33. In step SP33, the print controller 261 selects the waste toner amount W(n) with the greatest value among the waste toner amounts W(n) of the respective standard colors to set the selected value as a maximum waste toner amount W_max and proceeds to subsequent step SP34.

In step SP34, the print controller 261 calculates a reverse transfer ratio P(n) representing a degree at which the silver toner is to be reverse-transferred from the intermediate transfer belt 24 in each of the image formation units 10K, 100, 10M, and 10Y for the standard colors and proceeds to subsequent step SP35. The reverse transfer ratio P(n) is calculated based on a difference between the waste toner amount W(n) of each standard color and the maximum waste toner amount W_max and is a degree depending on the magnitude of this difference. In other words, the reverse transfer ratio P(n) represents a value at which an amount of silver waste toner to be collected is distributed to each of the image formation units 10K, 100, 10M, and 10Y for the standard colors located downstream of the image formation unit 10S for silver, the silver waste toner distributed at a proportion depending on how small the waste toner amount W(n) of each color is. Specifically, the reverse transfer ratio P(n) of each color is calculated from the following formula (7).

[Formula 7]

$$P(n) = \frac{(\mathrm{W_max} - W(n))}{\sum(\mathrm{W_max} - W(n))} \tag{7}$$

In step SP35, the print controller 261 calculates the primary transfer voltage V25 (hereinafter, referred to as transfer voltage Tr(n)) depending on the reverse transfer ratio P(n) for each of the image formation units 10K, 100, 10M, and 10Y for the standard colors and proceeds to subsequent step SP36. Specifically, the transfer voltage Tr(n) is calculated according to the following formula (8) by using a transfer voltage Tro(n) originally set in the case where no reverse transfer is performed, a transfer voltage correction value Trc(n) set for each image formation unit 10, and the reverse transfer ratio P(n).

[Formula 8]

$$Tr(n)=Tro(n)+P(n)\times Trc(n) \tag{8}$$

Figure 14:
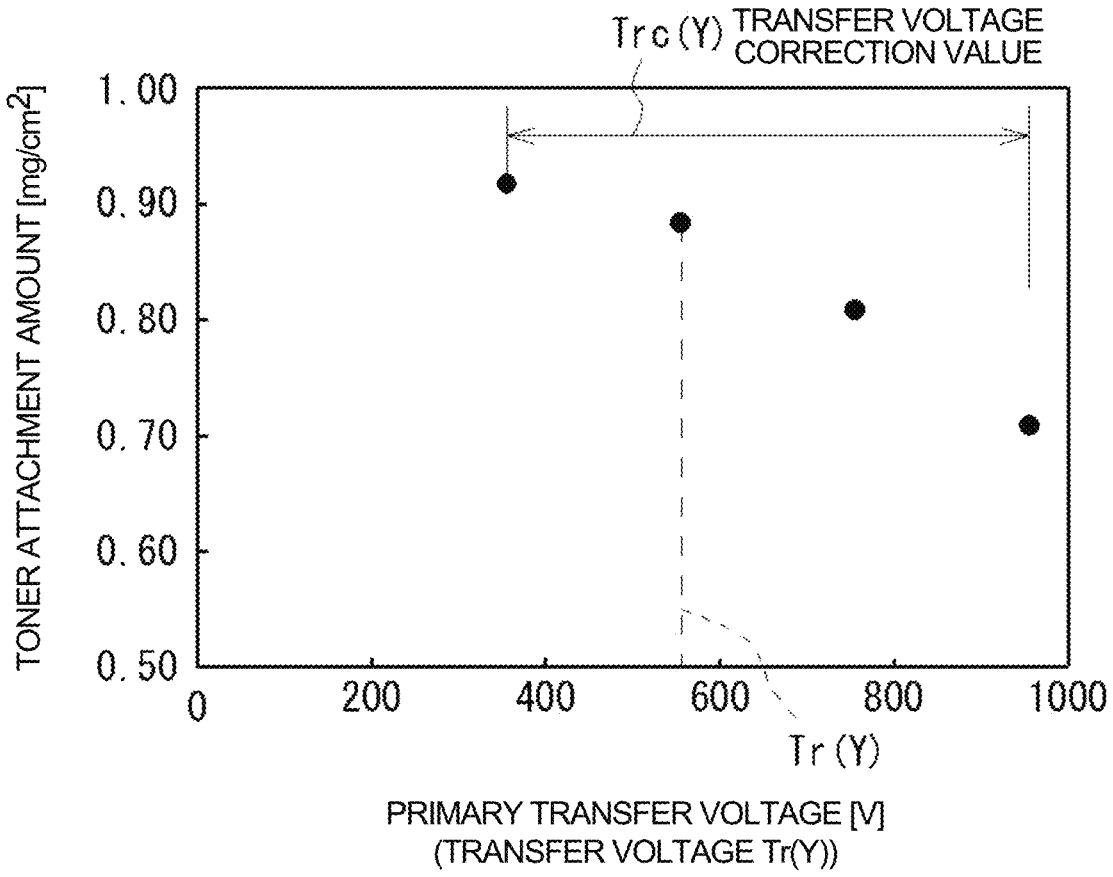
FIG. 14 is a schematic diagram illustrating a transfer voltage correction value and a relationship between the primary transfer voltage and the toner attachment amount.

FIG. 14 illustrates a relationship between the primary transfer voltage V25 (that is, transfer voltage Tr(Y)) and the toner attachment amount in the image formation unit 10Y for yellow as an example. In FIG. 14, the transfer voltage Tr(Y) varies depending on a value of a reverse transfer ratio P(Y) within a range of a transfer voltage correction value Trc(Y).

In step SP36, the print controller 261 causes the reverse transfer controller 82 and the high-voltage power supply controller 65 (FIG. 3) to perform control of setting the primary transfer voltage V25 supplied from the primary transfer voltage power supply 75 to each of the image formation units 10K, 100, 10M, and 10Y for the standard colors to the corresponding transfer voltage Tr(n) calculated in step SP35 and proceeds to subsequent step SP37.

[2-3. Effects and the Like]

In the aforementioned configuration, when the image formation apparatus 201 according to a second embodiment prints image data using silver, the image formation apparatus 201 reduces the layer thickness of silver in toner images transferred to the paper sheet 100 by using different methods depending on whether the other colors are used in the image data or not as in a first embodiment. The image formation apparatus 201 can thereby increase the proportion of the flat bright pigment particles that are contained in the silver toner and whose flat surfaces are in a posture nearly parallel to the sheet surface in an image eventually printed on the paper sheet 100 and achieve a state where the image reflects light in an excellent manner and has high brightness.

Particularly, when only silver is used in the image data, the image formation apparatus 201 reverse-transfers the silver toner from the intermediate transfer belt 24 in each of the image formation units 10K, 100, 10M, and 10Y for the standard colors at a proportion depending on the waste toner amount W(n), that is the storage amount of the waste toner storage portion 12B in the toner cartridge 12 of the image formation unit 10.

Accordingly, the image formation apparatus 201 can reverse-transfer relatively large amounts of toner in the image formation units 10K, 100, 10M, and 10Y for colors with large free spaces in the waste toner storage portions 12B and reverse-transfer relatively small amounts of toner in the image formation units 10K 10C, 10M, and 10Y for colors with small free spaces in the waste toner storage portion 12B. In other words, in the image formation apparatus 201, the amount of toner to be reverse-transferred can be appropriately distributed among the image formation units 10K, 100, 10M, and 10Y for the standard colors such that the waste toner amounts W(n) and the free spaces in the waste toner storage portions 12B of the respective colors are brought close to the same levels.

The image formation apparatus 201 can thereby avoid occurrence of such a waste that the toner cartridge 12 needs to be replaced due to lack of free space in the waste toner storage portion 12B in the image formation unit 10K, 10C, 10M, and 10Y for a certain standard color, even though the unused toner of this color is left in the toner storage portion 12A. Specifically, the image formation apparatus 201 can avoid a situation where new waste toner cannot be stored in the waste toner storage portion 12B as much as possible for all colors including silver and the standard colors.

The image formation apparatus 201 calculates the waste toner amount W(n) for each toner color by using the transfer residual toner amount Wtr, the toner disposal amount Wf, the fogging toner amount Wb, and the reverse transfer toner amount Wr, calculates the reverse transfer ratio P(n) for each color based on the waste toner amount W(n), and calculates the transfer voltage Tr(n) for each color. Accordingly, the image formation apparatus 201 can calculate the waste toner amount W(n) representing the amount of the waste toner stored in the waste toner storage portion 12B for each color at extreme accuracy by means of calculation processes, without being provided with a highly-accurate sensor and the like in the waste toner storage portion 12B.

In the formula (7) for calculating the reverse transfer ratio P(n), the image formation apparatus 201 calculates the reverse transfer ratio P(n) by dividing the difference between the waste toner amount W(n) of each color and the maximum waste toner amount W_max by the sum of these differences for all standard colors. Accordingly, the image formation apparatus 201 can calculate the values of the reverse transfer ratios P(n) that reduce the differences among the waste toner amounts W(n) of the respective standard colors, by means of a relatively simple calculation process.

The image formation apparatus 201 according to a second embodiment can exhibit the same operations and effects as those in the image formation apparatus 1 according to a first embodiment in the other points.

According to the aforementioned configuration, the image formation apparatus 201 according to a second embodiment reverse-transfers the toner in the image formation units 10K, 100, 10M, and 10Y for the standard colors when the standard colors are not used in printing of image data using silver. In this case, the image formation apparatus 201 calculates the reverse transfer ratios P(n) depending on the waste toner amounts W(n) of the respective standard colors and appropriately distributes the reverse-transferred toner. The image formation apparatus 201 can thereby reduce the layer thickness in the silver toner image without generating a white strip and improve brightness in an image eventually printed on the paper sheet 100 while distributing the silver waste toner to the waste toner storage portion 12B for silver or those for the standard colors and bringing the waste toner amounts W(n) of the respective standard colors close to one another.

[3. Other Embodiments]

In an aforementioned first embodiment, description is given of the case where the transfer efficiency is reduced in the image formation unit 10S for silver by increasing the transfer voltage from the standard voltage (about 500 [V])

when the image data is silver monochrome image data (FIG. 7). However, the disclosure is not limited to this method and, for example, the transfer efficiency may be reduced by, for example, reducing the transfer voltage from the standard voltage. The same applies to a second embodiment.

In aforementioned second embodiment, description is given of the case where the reverse transfer ratio P(n) of each standard color is calculated according to the formula (7) based on the waste toner amount W(n) of this standard color and the maximum waste toner amount W_max when no standard colors are used in the image data. However, the disclosure is not limited to this and the reverse transfer ratio P(n) may be calculated by various calculation methods such as, for example, a method in which a storable capacity of each standard color is calculated by subtracting the waste toner amount W(n) of this standard color from the maximum storable capacity of the waste toner storage portion 12B and the reverse transfer ratio P(n) is calculated depending on a ratio of this storable capacity. Basically, it is only necessary to calculate the reverse transfer ratio P(n) at a degree depending on the waste toner amounts W(n) of the respective standard colors, that is calculate the reverse transfer ratio P(n) that can reduce the differences among the waste toner amounts W(n) or storable capacities of the respective standard colors.

In an aforementioned second embodiment, description is given of the case where the silver toner is reverse-transferred only by the image formation units 10K, 100, 10M, and 10Y for the standard colors and stored in the waste toner storage portions 12B when no standard colors are used in the image data. However, the disclosure is not limited to this and, for example, a configuration in which the waste toner amount W(n) of silver is calculated in addition to those for the standard colors and the reverse transfer ratios P(n) are calculated according to the formula (7) for all colors including silver. In this case, it is only necessary to adjust the transfer efficiency depending on the reverse transfer ratio P(n) in the image formation unit 10S for silver. As a result, the transfer efficiency in the image formation unit 10S for silver is reduced from that in the case where the standard colors are used in the image data as in a first embodiment.

In an aforementioned second embodiment, description is given of the case where the image formation units 10K, 100, 10M, and 10Y for each standard color reverse-transfers the silver toner at a degree based on the reverse transfer ratio P(n) calculated at a ratio depending on the waste toner amount W(n) of this standard color when no standard colors are used in the image data. However, the disclosure is not limited this and, for example, only the image formation unit 10K, 100, 10M, and 10Y for the standard color with the smallest waste toner amount W(n) may reverse-transfer the silver toner. Alternatively, for example, only the image formation unit 10 with the smallest waste toner amount W(n) among those for all colors including silver may reverse-transfer the silver toner. When the waste toner amount W(S) of silver is the smallest, it is only necessary to reduce the transfer efficiency in the image formation unit 10S for silver and store the waste toner in the waste toner storage portion 12B of the image formation unit 10S as in the case where the image data includes the standard colors.

In an aforementioned second embodiment, description is given of the case where the reverse transfer ratio P(n) each standard color are calculated based on the ratio of the waste toner amount W(n) of the standard color when no standard colors are used in the image data. However, the disclosure is not limited to this and the reverse transfer ratios P(n) may be determined based on the amounts of the waste toner in the waste toner storage portions 12B. Examples of such configuration include a configuration in which, when the storage amount of the waste toner in the waste toner storage portion 12B (FIG. 2) for a certain color is less than a predetermined reference value, correction of improving the reverse transfer ratio P(n) of this color is performed. Alternatively, a correction of increasing and reducing the reverse transfer ratio P(n) can be performed. For example, when the amount of waste toner in the waste toner storage portion 12B for silver is less than the reference value and is relatively small, the waste toner may be stored in the waste toner storage portion 12B for silver by reducing the transfer efficiency of silver also in the case the where no standard colors are used in the image data.

In an aforementioned second embodiment, description is given of the case where the reverse transfer ratio P(n) of each standard color is calculated based on the waste toner amount W(n) of the standard color when no standard colors are used in the image data. However, the disclosure is not limited to this and correction of increasing or reducing the reverse transfer ratio P(n) based on the storage amount (that is, remaining amount) of the toner in the toner storage portion 12A may be performed. Examples of this configuration include a configuration in which, when the storage amount of the toner in the toner storage portion 12A (FIG. 2) of a certain color is less than a predetermined reference value and the toner cartridge 12 is likely to be replaced soon, correction of improving the reverse transfer ratio P(n) of this color is performed. In this case, for example, a toner amount calculation unit having a similar configuration to the waste toner amount calculator 285 (FIG. 12) can calculate the storage amount of the toner based on the amount of toner consumed in the print process, the density correction process, and the like as in the calculation of the waste toner amount W(n). This allows the waste toner to be stored preferentially in the waste toner storage portion 12B of the toner cartridge 12 that is to be replaced soon and free spaces in the waste toner storage portions 12B for the other colors can be saved. In this case, for example, when the remaining amount of the toner in the toner storage portion 12A for silver is relatively low and the toner cartridge 12 for silver is expected to be replaced soon, the waste toner may be stored in the waste toner storage portion 12B for the silver by reducing the transfer efficiency of silver also in the case where no standard colors are used in the image data.

In an aforementioned first embodiment, description is given of the case where part of the silver toner image transferred onto the intermediate transfer belt 24 is reversed-transferred in the image formation units 10K, 100, 10M, and 10Y for the standard colors when no standard colors are used in the image data. However, the disclosure is not limited to this and the layer thickness of the silver toner image may be reduced by, for example, reducing the transfer efficiency in the secondary transfer unit 43 located downstream of the image formation units 10K, 100, 10M, and 10Y for the standard colors without performing the reverse-transfer in the image formation units 10K, 100, 10M, and 10Y for the standard colors and thereby reducing the toner attachment amount of the silver toner image transferred to the paper sheet 100. In this case, for example, it is possible to move the image formation units 10K, 100, 10M, and 10Y for the standard colors upward and away them from the intermediate transfer belt 24 and stop the rotation of the photosensitive drums 17 and the like to suppress wear of the photosensitive drums 17 and the like. In this case, the silver waste toner can be stored in a portion other than the waste toner storage portion 12B for silver even if, for example, the image formation unit 10S for silver is arranged at the most downstream position in the traveling direction of the intermediate transfer belt 24 in the image formation apparatus 1 (FIG. 1) and no image formation units 10K, 100, 10M, and 10Y for the standard colors are arranged downstream of the image formation unit 10S for silver. Note that the toner not transferred from the intermediate transfer belt 24 to the paper sheet 100 can be scraped off from the intermediate transfer belt 24 by the belt cleaning unit 26 (FIG. 1). In this case, in the secondary transfer unit 43, it is desirable that the transfer voltage is reduced from the standard voltage to reduce the transfer efficiency unlike in the case of the primary transfer voltage V25 and charge amounts of the paper sheet 100 and the toner image after the transfer are thereby suppressed. It is possible to perform the reverse transfer in the image formation units 10K, 100, 10M, and 10Y for the standard colors and also reduce the transfer efficiency to the paper sheet 100 in the secondary transfer unit 43. The same applies to an aforementioned second embodiment.

In an aforementioned first embodiment, description is given of the case where the toner attachment amount to the intermediate transfer belt 24 is reduced for the silver toner image containing the pigment (specifically, metal pigment) made mainly of flat particles. However, the disclosure is not limited to this and the toner attachment amount to the intermediate transfer belt 24 may be reduced for toner images of other bright colors such as, for example, gold. Basically, the toner only needs to have certain brightness by containing a metal pigment such as aluminum. When the toner contains no metal pigment but contains a pigment made mainly of flat particles, the toner attachment amount to the intermediate transfer belt 24 in a toner image may be reduced. The same applies to an aforementioned second embodiment.

Note that the gold toner can be manufactured by, for example, changing some of manufacturing steps in manufacturing of the silver toner. Specifically, the gold toner can be manufactured by adding a yellow pigment (for example, C.I. Pigment Yellow 180 as an organic pigment), a magenta pigment (for example, C.I. Pigment Red 122 as an organic pigment), a red-orange fluorochrome (for example, FM-34N_Orange (manufactured by Sinloihi Co., Ltd.), and a yellow fluorochrome (for example, FM-35N_Yellow (manufactured by Sinloihi Co., Ltd.) in the addition of aluminum as the bright pigment.

In an aforementioned first embodiment, description is given the case where the image formation apparatus 1 is provided with the image formation units 10K, 100, 10M, and 10Y for the four colors of black, cyan, magenta, and yellow as the standard colors, in addition to the image formation unit 10S for silver. However, the disclosure is not limited to this and, for example, the image formation apparatus 1 may be provided with image formation units 10 for three or less colors or five or more colors in addition to the image formation unit 10S for silver. In this case, for example, various colors such as white and clear may be included as the colors other than silver and any toner containing a pigment made mainly of non-flat particles may be used. The same applies to an aforementioned second embodiment.

In an aforementioned first embodiment, description is given of the case where the image formation apparatus 1 employs the so-called intermediate transfer method and the toner images formed by the respective image formation units 10 are transferred to the intermediate transfer belt 24 and transferred from the intermediate transfer belt 24 to the paper sheet 100 in the secondary transfer unit 43. However, the disclosure is not limited to this and can be applied to, for example, the case where the toner images formed by the image formation units 10 are directly transferred to the paper sheet 100 in an image formation apparatus of a direct transfer method. The same applies to an aforementioned embodiment.

In an aforementioned first embodiment, description is given of the case where the interface controller 64 and the like of the controller 3 (FIG. 3) are configured as hardware circuits. However, the disclosure is not limited to this and, for example, the interface controller 64 and the like may be configured as software by executing a predetermined program like the transfer efficiency controller 81 and the like of the print controller 61. The transfer efficiency controller 81 and the like of the print controller 61 may be configured as hardware like the interface controller 64 and the like. The same applies to an aforementioned second embodiment.

In an aforementioned first embodiment, description is given of the case where the disclosure is applied to the image formation apparatus 1 that is a single function printer. However, the disclosure is not limited to this and may be applied to an image formation apparatus having other various functions such as, for example, a multi function peripheral (MFP) having functions of a photocopier and a facsimile apparatus. The same applies to an aforementioned second embodiment.

The disclosure is not limited to one or more embodiments described above. Specifically, the scope of application of the disclosure includes an embodiment that is obtained by arbitrary combining all or part of aforementioned embodiments or an embodiment that is obtained by extracting a part of an forementioned embodiment.

In an aforementioned first embodiment, description is given of the case where the image formation apparatus 1 as the image formation apparatus is formed of the image formation unit 10S as the first image formation unit, the image formation units 10K, 100, 10M, and 10Y as the second image formation units, the primary transfer rollers 25 as the transfer units, and the controller 3 as the controller. However, the disclosure is not limited to this and the image formation apparatus may be formed of a first image formation unit, a second image formation unit, a transfer unit, and a controller with various other configurations.

The disclosure can be used, for example, in the case where an image is printed on a paper sheet by forming a toner image in an electrophotographic method by using a toner containing a metal pigment.

The invention includes other embodiments in addition to the above-described one or embodiments and modifications without departing from the spirit of the invention. The above-described one or embodiments and modifications are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a first image formation unit that includes a first image carrier and is configured to form a first toner image on the first image carrier by using a bright toner containing a bright pigment;

a second image formation unit that includes a second image carrier and configured to form a second toner image on the second image carrier by using a non-bright toner not containing the bright pigment;

a transfer unit configured to transfer the first toner image and the second toner image to a transfer body; and a controller that controls the transfer unit, wherein the controller is configured to control a transfer efficiency of the bright toner to the transfer body when the second toner image is superimposed to the first toner image on the transfer body to be lower than a transfer efficiency of the bright toner to the transfer body when the second toner image is not superimposed to the first toner image formed on the transfer body.

2. The image formation apparatus according to claim 1, wherein the transfer unit includes a first transfer unit that transfers the first toner image from the first image carrier to the transfer body and a second transfer unit that transfers the second toner image from the second image carrier to the transfer body, and the controller is configured to control a voltage applied to the first transfer unit such that an absolute value of the voltage applied to the first transfer unit when the second toner image is not superimposed to the first toner image on the transfer body is smaller than an absolute value of the voltage applied to the first transfer unit when the second toner image is superimposed to the first toner image on the transfer body.

3. The image formation apparatus according to claim 1, wherein the transfer unit includes a first transfer unit that transfers the first toner image from the first image carrier to the transfer body and a second transfer unit that transfers the second toner image from the second image carrier to the transfer body, and the controller is configured, when the second toner image is not superimposed to the first toner image on the transfer body, to control the second transfer unit to reverse-transfer a part of the first toner image on the transfer body to the second image carrier.

4. The image formation apparatus according to claim 3, wherein the second image formation unit comprises a plurality of second image formation units each of which includes a second image carrier and configured to form a second toner image on the second image carrier by using a non-bright toner not containing the bright pigment, the second transfer unit includes a plurality of second transfer units corresponding to the second image formation unit to transfer the second toner images from the second image carriers of the second image formation units to the transfer body, the image formation apparatus further comprises:

a first waste toner storage portion that is provided for the first image formation unit and configured to store the bright toner that is not transferred from the first image carrier and is collected from the first image carrier as a waste toner;

second waste toner storage portions that are respectively provided for the second image formation units and configured to store the non-bright toners not transferred from the second image carriers and collected from the second image carriers and the bright toner collected from the transfer body by the second transfer units as waste toners; and a waste toner amount calculation unit that calculates a waste toner amount being an amount of the waste toner stored in each of the first waste toner storage portion and the second waste toner storage portions, and the controller is configured, when the second toner images are not superimposed to the first toner image on the transfer body, to control the second transfer unit corresponding to one of the second waste toner storage portions with the smallest waste toner amount to reverse-transfer a part of the first toner image on the transfer body to the second image carrier.

5. The image formation apparatus according to claim 3, wherein the second image formation unit comprises a plurality of second image formation units each of which includes a second image carrier and configured to form a second toner image on the second image carrier by using a non-bright toner not containing the bright pigment, the second transfer unit includes a plurality of second transfer units corresponding to the second image formation unit to transfer the second toner images from the second image carriers of the second image formation units to the transfer body, the image formation apparatus further comprises:

a first waste toner storage portion that is provided for the first image formation unit and configured to store the bright toner not transferred from the first image carrier and collected from the first image carrier as a waste toner;

second waste toner storage portions that are provided for the second image formation units and configured to store the non-bright toners not transferred from the second image carriers and collected from the second image carriers and the bright toner collected from the transfer body by the second transfer units as waste toners; and a waste toner amount calculation unit that calculates a waste toner amount that is an amount of the waste toner stored in each of the first waste toner storage portion and the second waste toner storage portions, and the controller is configured, when the second toner images are not superimposed to the first toner image on the transfer body, to control the second transfer units to reverse-transfer a part of the first toner image on the transfer body to the second image carriers at degrees depending on the waste toner amounts of the respective second waste toner storage portions.

6. The image formation apparatus according to claim 3, wherein the second image formation unit comprises a plurality of second image formation units each of which includes a second image carrier and configured to form a second toner image on the second image carrier by using a non-bright toner not containing the bright pigment, the second transfer unit includes a plurality of second transfer units corresponding to the second image formation unit to transfer the second toner images from the second image carriers of the second image formation units to the transfer body, the image formation apparatus further comprises:

second waste toner storage portions that respectively correspond to the second transfer units and are configured to store the non-bright toners not transferred from the second image carriers and collected from the second image carriers and the bright toner collected from the transfer body by the second transfer units as waste toners; and a waste toner amount calculation unit that calculates a waste toner amount that is an amount of the waste toner stored in each of the second waste toner storage portions, and the controller is configured, when the second toner images are not superimposed to the first toner image on the transfer body and the waste toner amount of any of the second waste toner storage portions is smaller than a predetermined reference value, to control the second transfer unit corresponding to the second waste toner storage portion with the waste toner amount smaller than the predetermined reference value to reverse-transfer a part of the first toner image on the transfer body to the second image carrier.

7. The image formation apparatus according to claim 6, further comprising a first waste toner storage portion configured to store the bright toner not transferred from the first image carrier and collected from the first image carrier as a waste toner, wherein the waste toner amount calculation unit calculates an amount of the waste toner stored in the first waste toner storage portion as the waste toner amount, and the controller is configured, when the second toner images are not superimposed to the first toner image on the transfer body, to control such that the transfer efficiency of the bright toner to the transfer body in a case where the waste toner amount of the first waste toner storage portion is smaller than the reference value is lower than the transfer efficiency of the bright toner to the transfer body in a case where the waste toner amount is equal to or greater than the reference value.

8. The image formation apparatus according to claim 3, wherein the second image formation unit comprises a plurality of second image formation units each of which includes a second image carrier and configured to form a second toner image on the second image carrier by using a non-bright toner not containing the bright pigment, the second transfer unit includes a plurality of second transfer units corresponding to the second image formation unit to transfer the second toner images from the second image carriers of the second image formation units to the transfer body, the image formation apparatus further comprises:

second waste toner storage portions that respectively correspond to the second transfer units and that are configured to store the non-bright toners not transferred from the second image carriers and collected from the second image carriers and the bright toner collected from the transfer body by the second transfer units as waste toners;

second toner storage portions that respectively correspond to the second transfer units and are provided integrally with the second waste toner storage portions and that stores the non-bright toners; and a toner amount calculation unit that calculate a toner amount being an amount of the non-bright toner stored in each of the second toner storage portions, and the controller is configured, when the second toner images are not superimposed to the first toner image on the transfer body and the toner amount of any of the second toner storage portions is smaller than a predetermined reference value, to control the second transfer unit corresponding to the second toner storage portion with the toner amount smaller than the predetermined reference value to reverse-transfer a part of the first toner image on the transfer body to the second image carrier.

9. The image formation apparatus according to claim 8, further comprising a first waste toner storage portion that is configured to store the bright toner not transferred from the first image carrier and collected from the first image carrier as a waste toner, and a first toner storage portion that is provided integrally with the first waste toner storage portion and that stores the bright toner, wherein the toner amount calculation unit calculates the toner amount stored in the first toner storage portion, and the controller is configured, when the second toner images are not superimposed to the first toner image on the transfer body, to control the transfer efficiency of the bright toner to the transfer body in a case where the toner amount of the first toner storage portion is smaller than the reference value to be lower than the transfer efficiency of the bright toner to the transfer body in a case where the toner amount is equal to or greater than the reference value.

10. The image formation apparatus according to claim 1, wherein the bright toner contains the bright pigment with higher light reflectance than a pigment contained in the non-bright toner.

11. The image formation apparatus according to claim 1, wherein the non-bright toner does not contain the bright pigment and contains a pigment with lower light reflectance than the bright pigment.

12. The image formation apparatus according to claim 1, wherein the bright pigment of the bright toner includes flat plate shaped or flat shaped thin pieces or scale shaped small pieces.

13. An image formation apparatus comprising:

a first image formation unit that includes a first image carrier and is configured to form a first toner image on the first image carrier by using a bright toner containing a bright pigment;

a second image formation unit that includes a second image carrier and is configured to form a second toner image on the second image carrier by using a non-bright toner not containing the bright pigment;

a transfer unit configured to transfer the first toner image and the second toner image to a transfer body;

a first waste toner storage portion that is configured to store the bright toner not transferred from the first image carrier and collected from the first image carrier as a waste toner;

a second waste toner storage portion that is configured to store the non-bright toner not transferred from the second image carrier and collected from the second image carrier and the bright toner collected from the transfer body as waste toners; and a controller that controls the transfer unit, wherein the controller is configured to control a proportion of the bright toner of the first toner image to be collected as the waste toner from the first image carrier into the first waste toner storage portion such that the proportion in a case where the second toner image is superimposed to the first toner image formed on the transfer body is higher than the proportion in a case where the second toner image is not superimposed to the first toner image formed on the transfer body.

* * * * *